US008162731B2

(12) United States Patent
Noda et al.

(10) Patent No.: US 8,162,731 B2
(45) Date of Patent: Apr. 24, 2012

(54) GAME DEVICE, GAME SYSTEM AND GAME PROGRAM

(76) Inventors: Masataka Noda, Tokyo (JP); Makoto Yamamoto, Tokyo (JP)

( * ) Notice: Subject to any disclaimer, the term of this patent is extended or adjusted under 35 U.S.C. 154(b) by 454 days.

(21) Appl. No.: 11/989,156

(22) PCT Filed: Jul. 19, 2006

(86) PCT No.: PCT/JP2006/314225

§ 371 (c)(1),
(2), (4) Date: Mar. 22, 2010

(87) PCT Pub. No.: WO2007/010916

PCT Pub. Date: Jan. 25, 2007

(65) Prior Publication Data

US 2010/0176555 A1 Jul. 15, 2010

(30) Foreign Application Priority Data

Jul. 20, 2005 (JP) ..... 2005-209528

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 463/1; 273/374; 273/378

(58) Field of Classification Search ..... 463/3, 5
See application file for complete search history.

(56) References Cited

U.S. PATENT DOCUMENTS

| | | | | |
|---|---|---|---|---|
| 4,333,657 | A * | 6/1982 | Jaworski et al. | 273/376 |
| 5,114,155 | A * | 5/1992 | Tillery et al. | 273/371 |
| 5,971,397 | A * | 10/1999 | Miguel et al. | 273/371 |
| 6,896,618 | B2 * | 5/2005 | Benoy et al. | 463/25 |
| 2001/0053722 | A1 * | 12/2001 | Miller | 473/462 |
| 2005/0121855 | A1 * | 6/2005 | Noda et al. | 273/348 |
| 2005/0209008 | A1 | 9/2005 | Shimizu et al. | |
| 2006/0068867 | A1 * | 3/2006 | White et al. | 463/13 |
| 2006/0076404 | A1 * | 4/2006 | Frerking | 235/382 |

FOREIGN PATENT DOCUMENTS

| | | |
|---|---|---|
| JP | 7-334185 | 12/1995 |
| JP | 11-023195 | 1/1999 |
| JP | 2001-113051 | 4/2001 |
| JP | 2002-325962 | 11/2002 |
| JP | 2003-181130 | 7/2003 |
| JP | 2004-261202 | 9/2004 |
| JP | 2005-052478 | 3/2005 |
| JP | 2005-131232 | 5/2005 |
| WO | WO-03/103788 | 12/2003 |

* cited by examiner

*Primary Examiner* — David L Lewis
*Assistant Examiner* — Reginald Renwick
(74) *Attorney, Agent, or Firm* — Jordan and Hamburg LLP

(57) ABSTRACT

[Problems] Unfair operation of "hand-push" is effectively handled.
[Means for Solving Problems]
It is judged whether a pressure continues for not less than a predetermined time or not, that is, it is judged whether there is possibility of hand-push or not. When the pressure continues for not less than a predetermined time, it is decided that there is a possibility of hand-push.

7 Claims, 20 Drawing Sheets

GAME DEVICE, GAME SYSTEM AND GAME PROGRAM

BACKGROUND OF THE INVENTION

The present invention relates to a game machine, game system and game program to which target hitting games such as darts are applied.

In recent years, electronic darts machines spread, which detect hit areas of darts so as to automatically record points of each player and to sum the points up. Since the contents of the game follow the traditional darts, the game machines lack in easy fun and cheerful activity.

Therefore, the inventors of the present invention proposed a game machine and game method by which beginners can easily join a game of lots of amuse. (Patent Application No. 2003-372553)

However, during practical management of the game machine, unfair operation of obtaining points by pushing board by hand (called "hand-push" hereafter) occur. There is no effective measure for preventing the hand-push.

There is a problem that a display of points record and sum and a display of executed game are intermixed causing confusion and inconvenience for playing, when a play of a plurality of players is automated.

There is another problem that it is difficult to compare players' scores because scores are simply arranged side by side, when the game record information of the plural players is displayed on the display.

There is further another problem that is difficult to display characters freely because the game machine has no character input means.

The present invention is invented so as to solve the above conventional problems and has an object to cope with the unfair operation of hand-push effectively, to clearly display achievement such as score, and to display characters freely on the game machine without character input means.

According to the present invention, the unfair operation of the hand-push is effectively handled.

A game machine according to the present invention comprises arrows, a target, a sensor for detecting an area of said target where pressure is put when said pressure is put, a control unit to which a detecting result of said sensor is input, a display monitor controlled by said control unit, a card reader for reading players' ID cards, and a hand-push judgment means for judging whether said target is hit by said arrow or push by other means than said arrows according to duration time of said pressure, wherein said target is divided into a plurality of areas each of which an indicator is allocated to, said arrows are thrown by said plurality of players successively, and a game is proceeded according to indicators of said areas hit by said arrows.

Therefore, the unfair operation of the hand-push is effectively handled.

The game machine according to the present invention may include a communication means for transmitting number of times and time interval of said pressure on said target and judgment of said hand-push judgment means.

A game machine according to the present invention comprises arrows, a target divided into a plurality of areas each of which an indicator is allocated to, a sensor for detecting an area of said target where pressure is put when said pressure is put, a control unit to which a detecting result of said sensor is input, a display monitor controlled by said control unit, a card reader for reading players' ID cards, and a communication means for transmitting an ID of a manager of said game machine by said indicators when pressure is put on said target on 1st condition that game is not executed, wherein said target is divided into a plurality of areas each of which an indicator is allocated to, said arrows are thrown by said plurality of players successively, and a game is proceeded according to said indicators of said areas hit by said arrows. So, the first condition that game is not executed can be set.

Therefore, register for certification can be easily executed during so-called test mode.

A game machine according to the present invention comprises arrows, a target divided into a plurality of areas each of which an indicator is allocated to, a sensor for detecting an area of said target where pressure is put when said pressure is put, a control unit to which a detecting result of said sensor is input, a display monitor controlled by said control unit, a card reader for reading players' ID cards, and a communication means for executing communication in order to obtain a ranking of said players when pressure is put on said target on 2nd condition that game is not executed, wherein said target is divided into a plurality of areas each of which an indicator is allocated to, said arrows are thrown by said plurality of players successively, and a game is proceeded according to said indicators of said areas hit by said arrows. So, the second condition that game is not executed can be set.

Therefore, the ranking can be easily obtained during so-called advertisement mode.

A game machine according to the present invention comprises arrows, a target divided into a plurality of areas each of which an indicator is allocated to, a sensor for detecting an area of said target where pressure is put when said pressure is put, a control unit to which a detecting result of said sensor is input, a display monitor controlled by said control unit, a card reader for reading players' ID cards, and a display means for displaying information of plurality of said ID cards on said display monitor in an arrangement corresponding to reading position of said ID cards, wherein said target is divided into a plurality of areas each of which an indicator is allocated to, said arrows are thrown by said plurality of players successively, and a game is proceeded according to said indicators of said areas hit by said arrows.

On the game machine according to the present invention, said game is proceeded by predetermined times of arrow throw of each said player, a point display means for displaying points of said players on said display monitor according to indicators corresponding to said areas hit by said arrows, and a brightness adjusting means for making said point display lighter at 1st throw among predetermined throw times, for adjusting said point display darker after said 1st throw, and making said point display lighter again after said predetermined throw times.

Therefore, the display image during the arrow throw is simplified and the players can concentrate on throwing the arrows.

A game system according to the present invention comprises a game machine and a server, and said game machine comprises, arrows, a target, a sensor for detecting an area of said target where pressure is put when said pressure is put, a control unit to which a detecting result of said sensor is input, a display monitor controlled by said control unit, a card reader for reading players' ID cards, and a hand-push judgment means for judging whether said target is hit by said arrow or push by other means than said arrows according to duration time of said pressure, a communication means for transmitting number of times and time interval of said pressure on said target and judgment of said hand-push judgment means, wherein said target is divided into a plurality of areas each of which an indication is allocated to, said arrows are thrown by said plurality of players successively, and a game is proceeded according to indicators of said areas hit by said arrows, and said server comprises a player information control means for controlling information of said ID cards and achievement corresponding to said ID cards, and a valid arrow throw judgment means for judging whether said arrow throw is valid or not according to said number of times and said time interval of said pressure on said target and said judgment of said hand-push judgment means which are transmitted from said communication means.

Therefore, the unfair operation of hand-push is effectively handled.

On the game system according to the present invention, said valid arrow throw judgment means judges 1st and 2nd conditions, that is, $HD \times PT > ND$, 1st condition:

$HD \times S \times G \times TD > TT$, 2nd condition:

where,

ND: number of times of said pressure on said target,

TT: time length necessary for said pressure of ND times,

HD: number of times, among ND times, that said hand-push judgment means judges said target is push by other means than said arrows, PT: a threshold of hand-push ratio (HD/ND), TD: a threshold of said time interval of said arrow throw, S: a coefficient concerning single, single game or doubles game, and S=1 when single, and S=2 when doubles, and G: number of groups, so as to judges said arrow throw is invalid when either said 1st or 2nd condition is fulfilled.

The game system according to the present invention comprises a game machine, a server which communicates with said game machine, and a communication terminal which communicates with said server and transmits information to be transmitted to said game machine to said server, said game machine comprises, arrows, a target, a sensor for detecting an area of said target where pressure is put when said pressure is put, a control unit to which a detecting result of said sensor is input, a display monitor controlled by said control unit, and a card reader for reading players' ID cards, wherein said target is divided into a plurality of areas each of which an indicator is allocated to, said arrows are thrown by said plurality of players successively, and a game is proceeded according to indicators of said areas hit by said arrows, wherein said server transmits information received from said communication terminal to said game machine.

Therefore, messages etc. can be easily provided by the game machine without character input means.

A game system according to the present invention comprises a game machine and a server, said game machine comprises arrows, a target, a sensor for detecting an area of said target where pressure is put when said pressure is put, a control unit to which a detecting result of said sensor is input, a display monitor controlled by said control unit, and a card reader for reading players' ID cards, wherein said target is divided into a plurality of areas each of which an indicator is allocated to, said arrows are thrown by said plurality of players successively, and a game is proceeded according to indicators of said areas hit by said arrows, and said server comprises a control means for controlling number of it times of said predetermined areas of said target such as bull, and a reward setting means for setting rewards for said players of said ID cards when said number of hit times reach a predetermined value.

The present invention is a game program including program codes executable by a computer, for a game machine which comprises a sensor for detecting an area of said target where pressure is put when said pressure is put, a control unit to which a detecting result of said sensor is input, a display monitor controlled by said control unit, and a card reader for reading players' ID cards, wherein said target is divided into a plurality of areas each of which an indicator is allocated to, said arrows are thrown by said plurality of players successively, and a game is proceeded according to indicators of said areas hit by said arrows, comprises, a hand-push judgment step for judging according to duration time of said pressure on said target whether said target is hit by said arrow or push by other means than said arrows, a step for judging 1st condition, that is, $HD \times PT > ND$, 1st condition:

where,

ND: number of times of said pressure on said target,

TT: time length necessary for said pressure of ND times,

HD: number of times, among ND times, that said hand-push judgment means judges said target is push by other means than said arrows, PT: a threshold of hand-push ratio (HD/ND), TD: a threshold of said time interval of said arrow throw, S: a coefficient concerning single game or doubles game, and S=1 when single, and S=2 when doubles, and G: number of groups, a step for judging 1st condition, that is, $HD \times S \times G \times TD > TT$, and 2nd condition:

a judging step for judging that said arrow throw is invalid when either said 1st or 2nd condition is fulfilled, otherwise, valid.

Therefore, the unfair operation of hand-push is effectively handled.

DETAILED DESCRIPTION OF THE INVENTION

[Game Machine and Game System]

Figure 1:
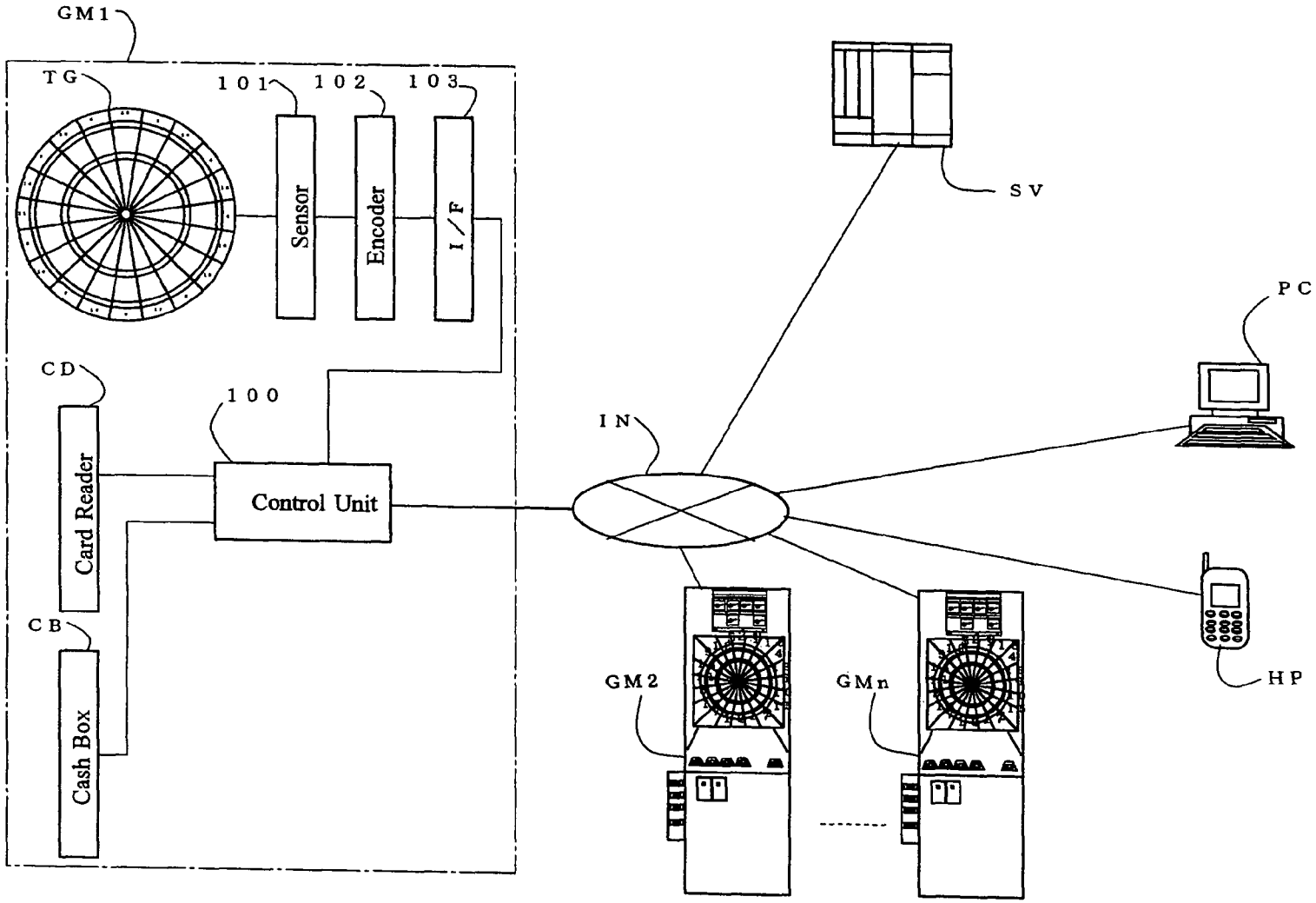
FIG. 1 is a block diagram showing a game system including the 1st embodiment of the game machine according to the present invention. (Embodiment)
Figure 2:
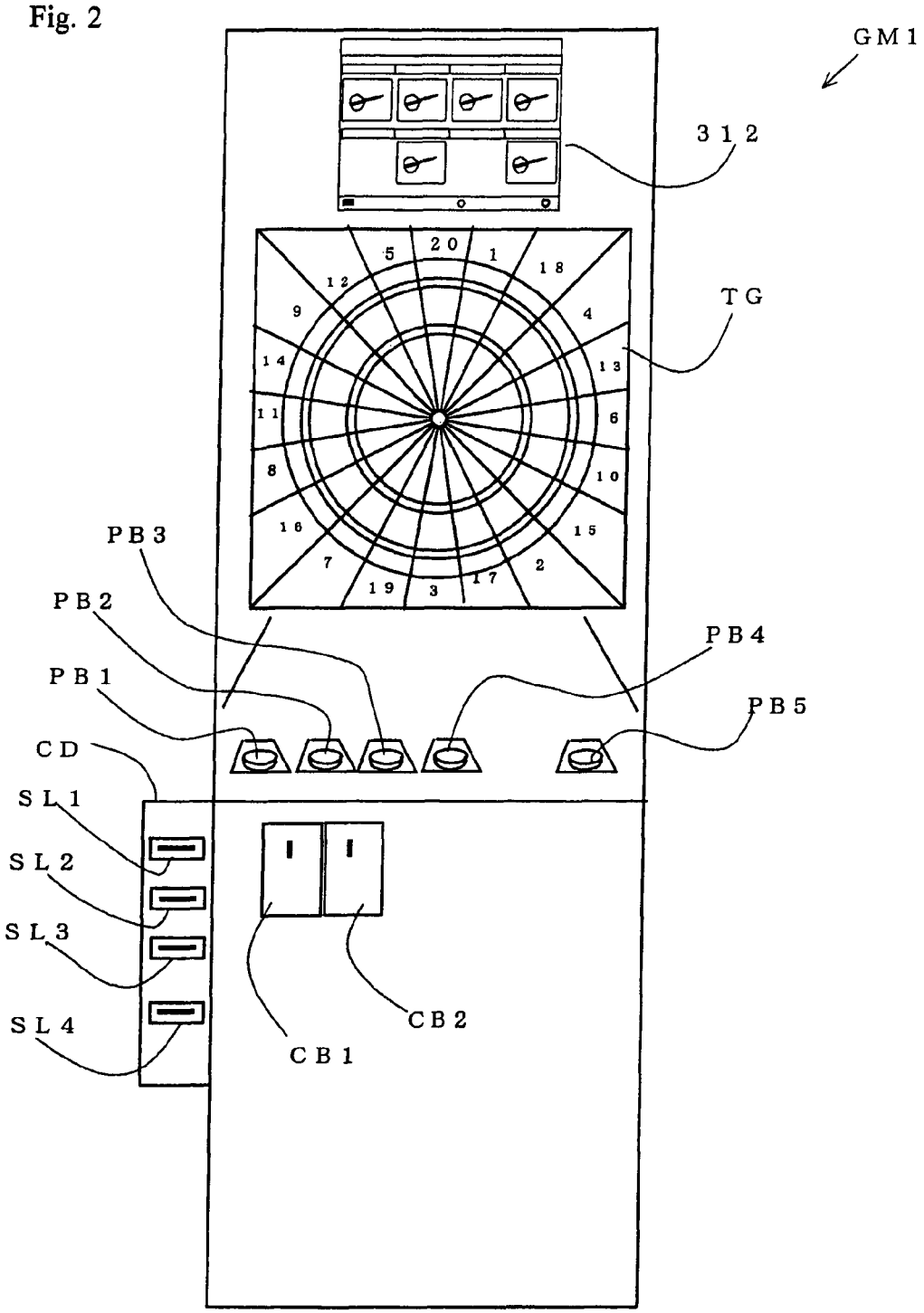
FIG. 2 is an elevation view of the game machine in FIG. 1. (Embodiment)
Figure 3:
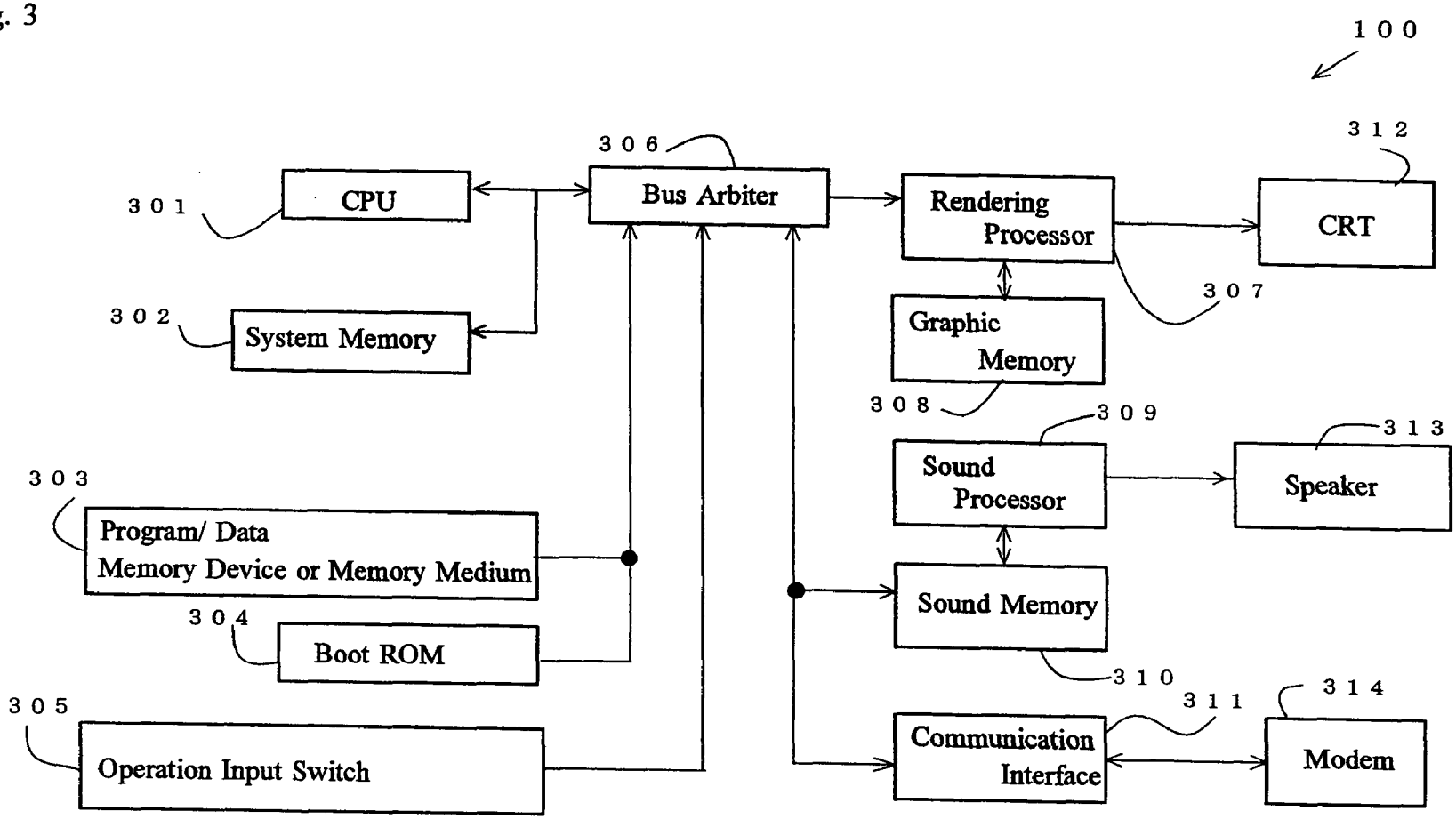
FIG. 3 is a block diagram showing the game machine in FIG. 1. (Embodiment)
Figure 4:
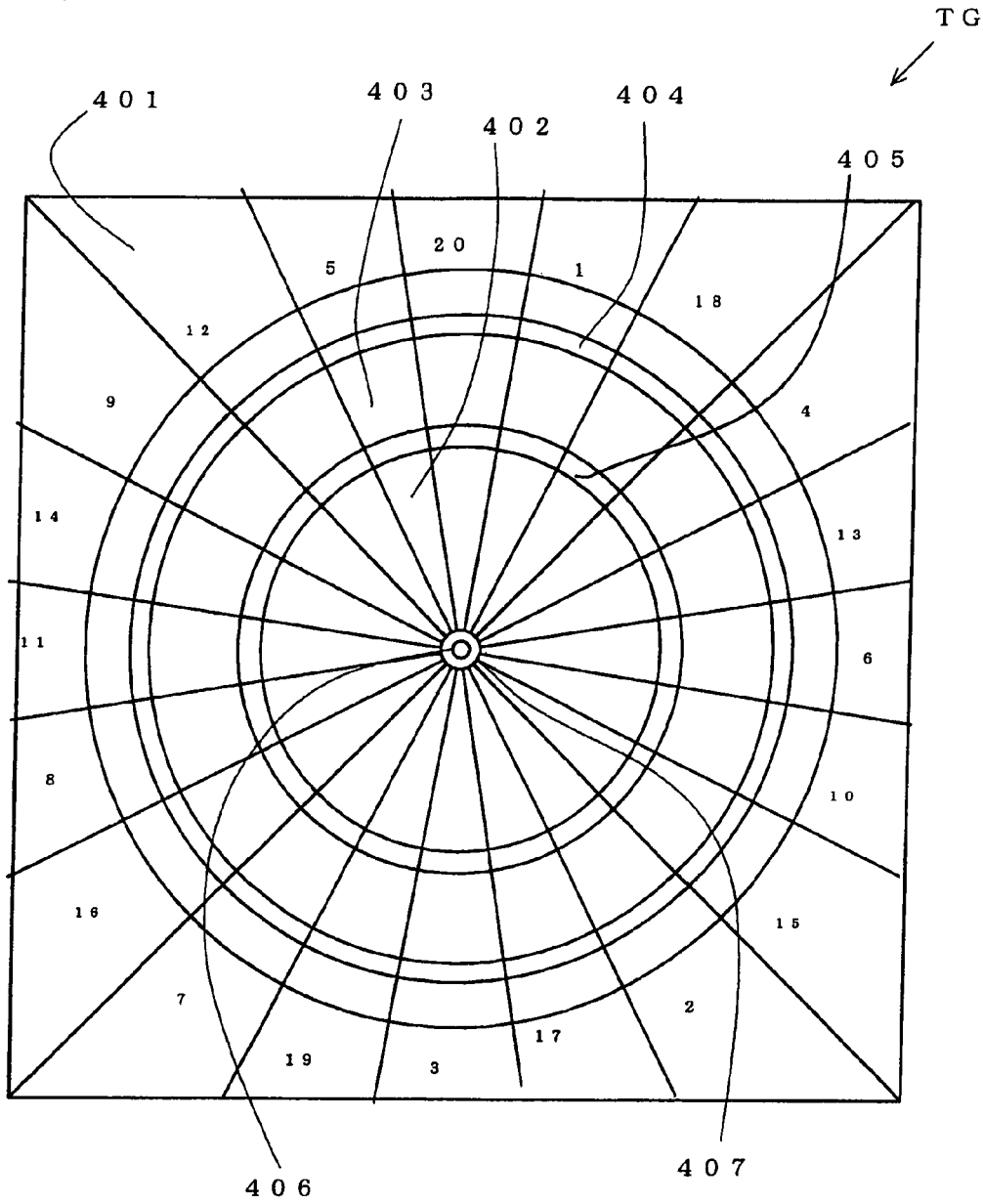
FIG. 4 is an elevation view showing the target of the game machine in FIG. 1. (Embodiment)

FIG. 1 is a block diagram showing a game system including the 1st embodiment of the game machine according to the present invention. FIG. 2 is an elevation view of the game machine in FIG. 1. FIG. 3 is a block diagram showing the game machine in FIG. 1. FIG. 4 is an elevation view showing the target of the game machine in FIG. 1.

In FIG. 1, a plurality of game machines GM1, GM2, . . . , GMn are connected to a network IN to which a server SV, one or more personal computers PC, a handy phone PH or other communication terminals are connected.

The server SV inputs and outputs various information to and from the game machines GM1 to GMn connected to the network and controls a game when necessary. Players (not shown) of the game machines GM1 to GMn perform operation and inputting by means of a control unit 1000 included in the game machines GM1 to GMn for executing the game on the game machines GM1 to GMn.

The game machine GM1 is described representatively. The game machine GM1 includes a target TG of the darts as one of target hitting game, a sensor 101 for detecting area where an arrow (not shown) hit, an encoder 102 for converting an detecting result of the sensor 101 into a numeral data and an interface 103 for inputting a signal of the encoder 102 to a control unit 100.

Therefore, the darts itself or other games adapting the darts can be controlled by the control unit 100.

A card reader CD and a cash-box CB are connected to the control unit 100 so that the control unit 100 detects fee (coin) inserted for executing the game and that the control unit 100 detects an ID card identifying a player so as to obtain the player's own information from the server SV.

The personal computer PC, the handy HP and other communication terminals can obtain various information concerning the game such as statistical result of the game machines GM1 to GMn, a ranking of the players and event information.

In FIG. 2, the target TG, a CRT 312, the card reader CD and the cash-box CB are provided on the front face of the game machine GM1. The player inserts the coin and his own ID card into the cash-box CB and the card reader CD, respectively. The card reader CD is provided with a plurality of (for example, 4) slots SL1 to SL4 so that a plurality of players can join the same game. It is also possible that a plurality of cards are inserted into each of the slots SL1 to SL4 for team competition such as "doubles".

The CRT 312 displays information concerning the game and has a function of a game display when a game adopting the darts is executed.

The target TG is not only target hit by the arrow but also a tool by which players obtain points, areas or numerals by arrow throwing.

Buttons PB1 to PB4 corresponding to slots SL1 to SL4 and a button PB5 for cancelling and for "Player Change" of the darts are provided on the game machine GM1. These buttons PB are used as an operation input switch 305 (FIG. 3) for the control unit 100. A Joystick or other input means may be provided in the game machine GM1 as the operation input switch 305.

In FIG. 3, the control unit 100 includes a CPU 301, a boot ROM for storing a program for starting up the control unit 100 and a system memory 302 for storing a program executed by the CPU 301 and data.

The control unit 100 is provided with a rendering processor 307 for generating and for controlling an image to be displayed. A graphic memory 308 is provided in the control unit 100 for storing the generated image and material images for the generated image. The rendering processor 307 displays the generated image on the CRT 312.

A sound processor 309 for generating sound and a sound memory 310 for storing sound to be generated are provided in the control unit 100. The sound processor 309 generates a digital signal of the sound according to the data stored in the sound memory 310 so that the sound is output from a speaker 313 or a headphone (not shown).

A program data memory device or memory medium 303 is provided in the control unit 100. Game programs and data are transfer into the system memory 302, graphic memory 308 and sound memory 310.

The data stored in the memory medium 303 includes information concerning games.

A communication interface 311 and a MODEM 314 are provided in the control unit 100. The control unit 100 is connected through the MODEM 314 to the network IN.

The above components of the control unit 100 are connected to a bus and are arbitrated by a bus arbiter in communication.

A virtual player as subjective player representing the player may be registered in the ID card so that the virtual players play a match against one another.

In FIG. 4, the target TG is a well-known target of the darts, which has "bull" area of small circle in the center. The rest area around the bull area is divided along the circumference into 20 equal fan shape areas. Each fan shape area is divided into 4 areas along the radius.

The innermost area 402 of the fan shape area and the third from the area 403 from the area 402 are rather wide area called "single". The second area 405 from the area 402 is a rather narrow area called "triple ring" and the outermost area 404 is a narrow area called "double ring".

The bull area is radially divided into 2 so that 2 inner and outer areas 406 and 407 are shaped. In the bull area, the inner area 406 is called "double bull" or "inner bull" and the outer area 407 is called "single bull" or "outer bull". Generally, the area 406 is of higher point than the area 407.

Basic numerals are allocated to the fan-shape areas, that is, upper most center area is given "20" and the other areas are given "5", "12", "9", "14", "11", "8", "16", "7", "19", "3", "17", "2", "15", "10", "6", "13", "4", "18" and "1" along the circumference in the anticlockwise direction from the area "20". These numerals are shown by a display in the outer area 401. The location of the display is not limited to the area 401 and the location may be the single area etc.

[Card Data Display]

Figure 5:
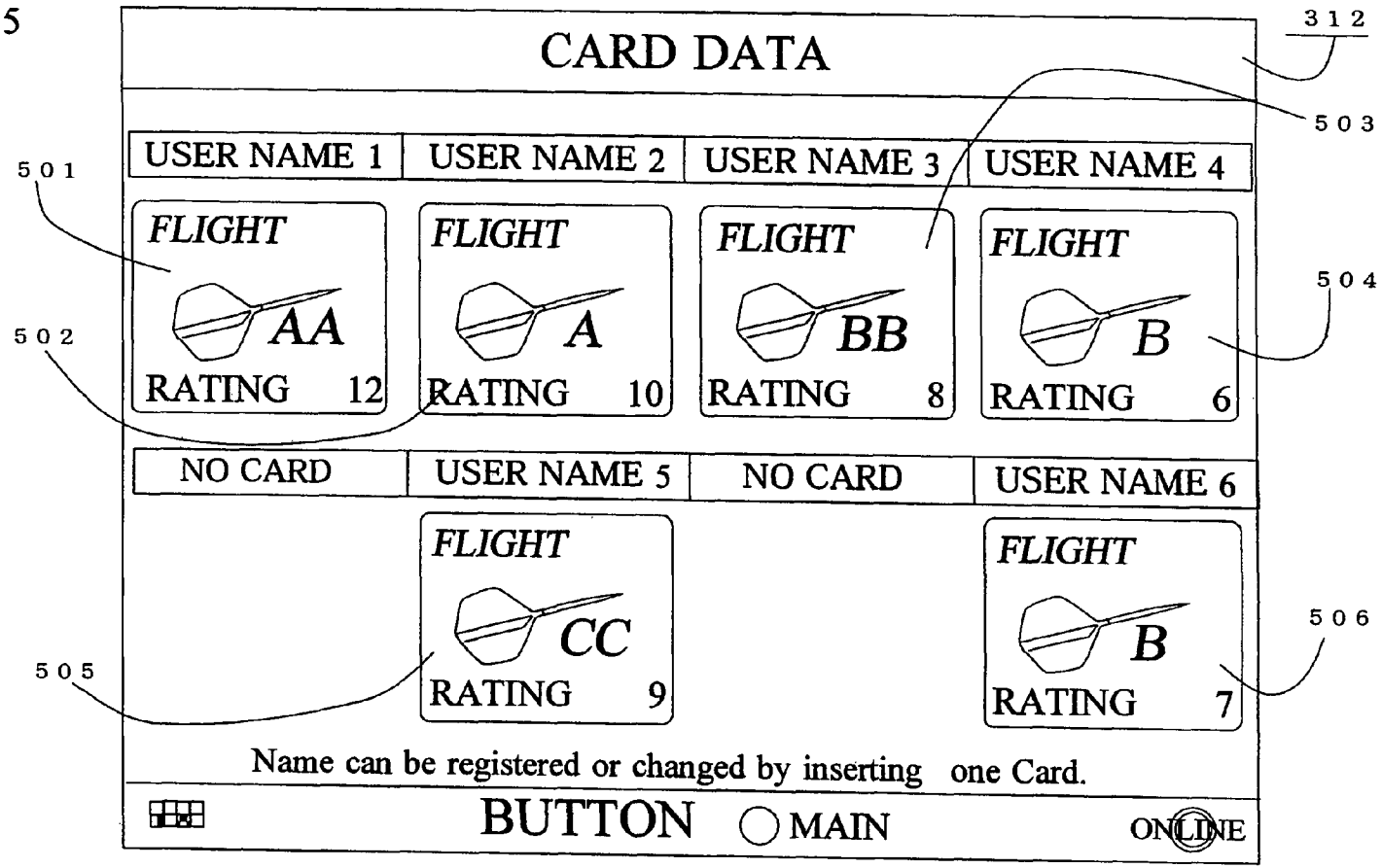
FIG. 5 is a figure showing an example of card data displayed on the display unit of the game machine in FIG. 1. (Embodiment)
Figure 6:
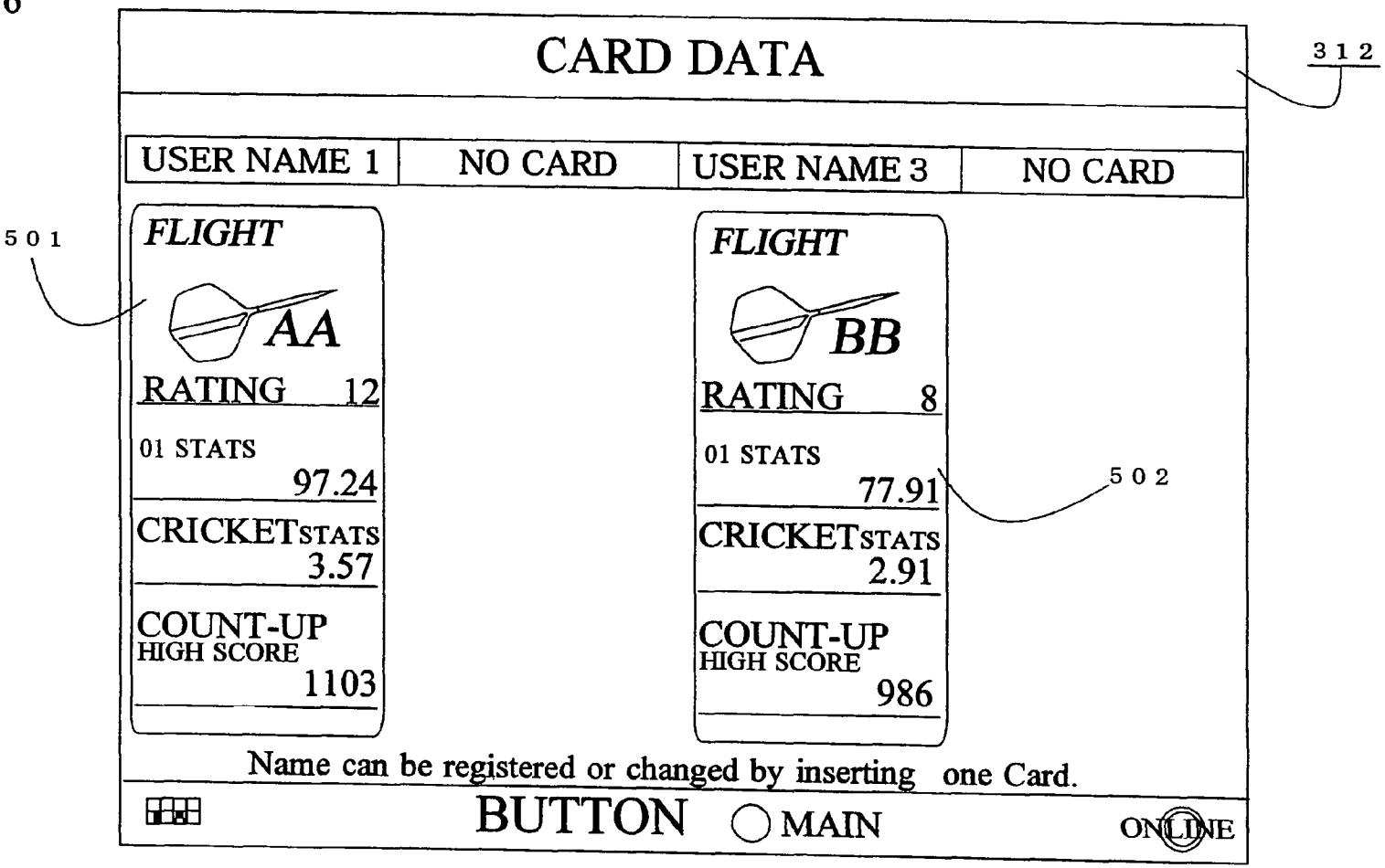
FIG. 6 is a figure showing another example of card data displayed on the display unit of the game machine in FIG. 1. (Embodiment)
Figure 7:
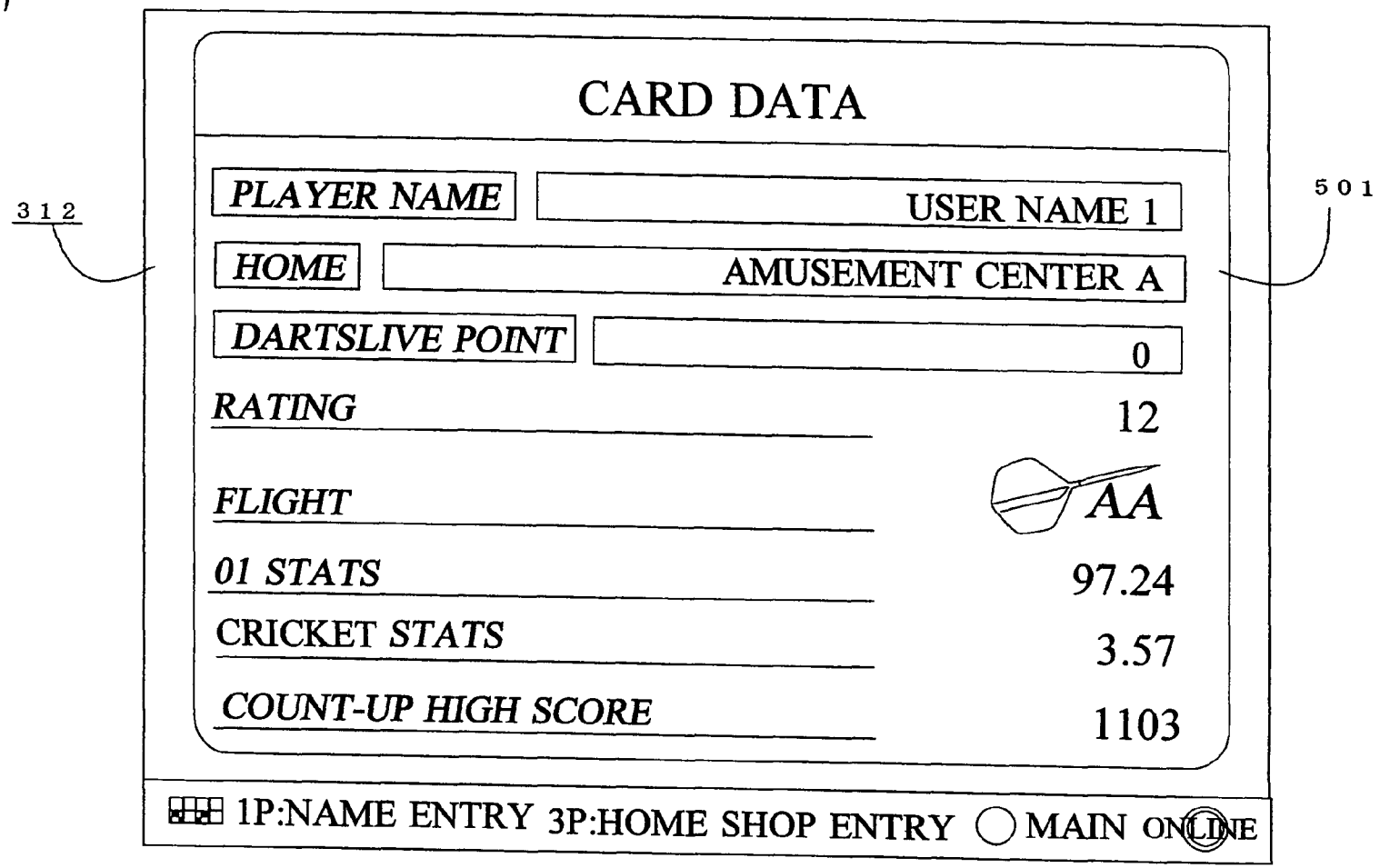
FIG. 7 is a figure showing further another example of card data displayed on the display unit of the game machine in FIG. 1. (Embodiment)

FIGS. 5, 6 and 7 are figures showing examples of card data displayed on the display unit of the game machine in FIG. 1.

In FIG. 5, data of the ID cards 501, 502, 503 and 504 are displayed in this order along an upper horizontal line from left to right on the display unit 312. Data of ID card 505 is shown under the ID card 502, and data of ID card 504 is shown under the ID card 506. This data arrangement from left right corresponds to slots SL1, SL2, SL3 and SL4.

That is, the ID card 501 is inserted into the slot SL1, the ID cards 502 and 505 are inserted into the slot SL2, the ID card 503 is inserted into the slot SL3, and the ID cards 504 and 506 are inserted into the slot SL4.

On the upper side of the ID cards 501 to 506, players' names of USER Name 1, USER Name 2, USER Name 3, USER Name 4, USER Name 5 and USER Name 6 are shown. As card data, a rating set for each ID card is shown, for example. The rating is an indicator of game ability according to past game achievement.

By displaying ID cards, at most 8 ID cards, at positions corresponding to slots into which the ID cards are inserted, positions and combinations of players are clearly shown.

In FIG. 5, there are shown "BUTTON MAIN" and "ONLINE". "BUTTON MAIN" means that the display image returns to a main menu image such as a game select image by pushing the buttons from PB1 to PB5 etc. "ONLINE" means that the game machine GM1 works online, connected with the server.

FIG. 6 shows a display mode for displaying card data of 4 cards at most. On the display unit 312, the data of the ID card 501 is shown at the left end. On the right of the ID card 501, with a distance of one blank area, the data of the ID card 503 is shown. A blank area exists on the right of the ID card 503. The arrangement of the cards corresponds to the slots SL1, SL2, SL3 and SL4.

In the display image of FIG. 6, more detailed data other than the rating such as "01STATS", "CRICKETSTATS" and "COUNT-UP HIGH SCORE" can be shown, because less cards than in FIG. 5 are shown.

FIG. 7 shows a display mode for displaying only one card data. On the display unit 312, the data of the ID card 501 is shown.

In the display image of FIG. 7, further more detailed data other than the rating, "01STATS", "CRICKETSTATS" and "COUNT-UP HIGH SCORE" can be shown, because the least card is shown.

In the display image of FIG. 7, "1P:NAME ENTRY", "3P: HOME SHOP ENTRY", "MAIN" and "ON LINE" are shown at the bottom. By "1P:NAME ENTRY", the display image is changed to an image for registering name such as players' user names. By "3P: HOME SHOP ENTRY", the display image is changed to an image for selecting and registering shop most frequently visited by the player of the best favorite with the players. "ONLINE" means that the game machine GM1 works online, connected with the server.

[Game Image]

FIGS. 8, 9, 10 and 11 are figures showing example of other game images shown on the display unit of the game machine.

Figure 8:
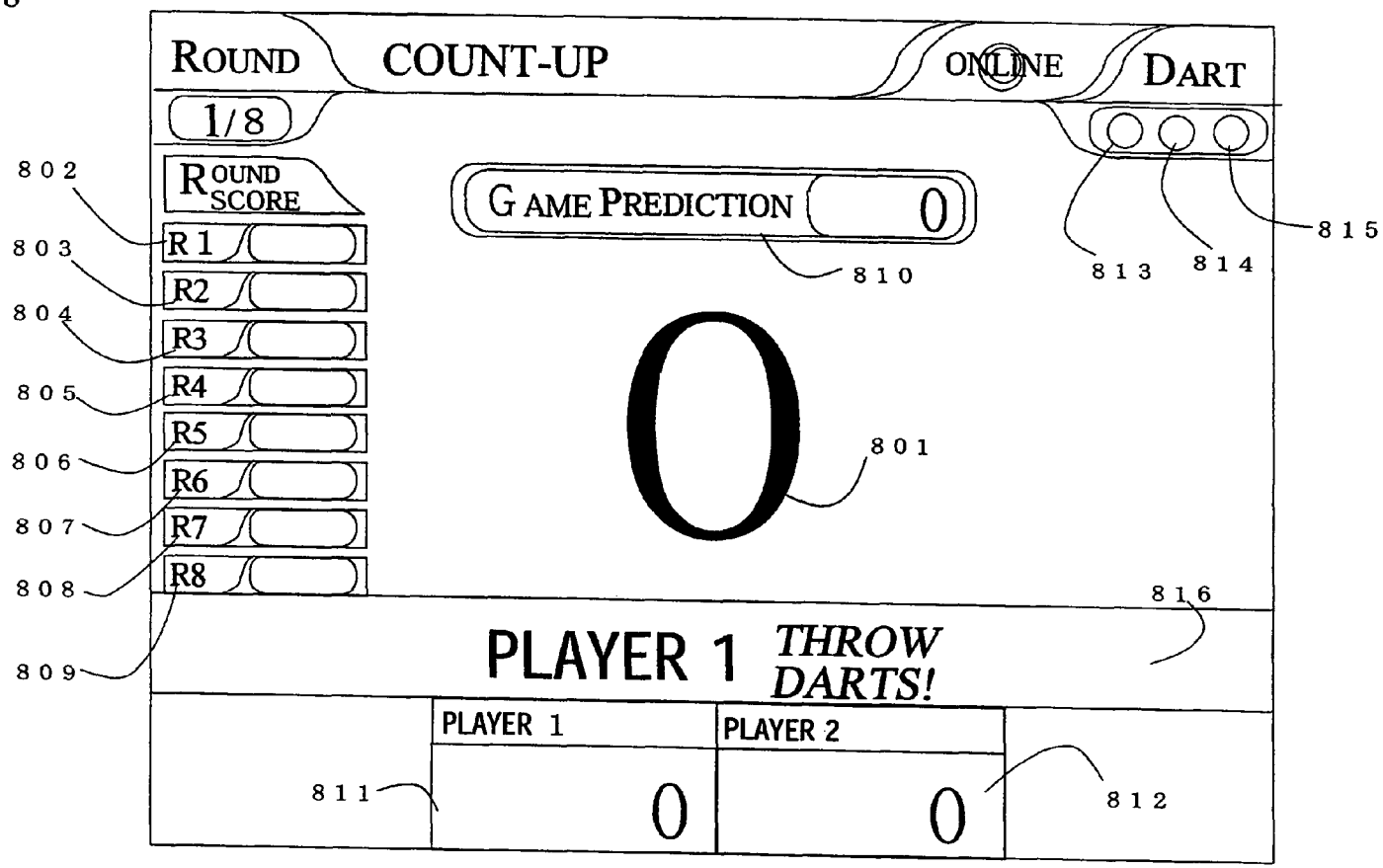
FIG. 8 is a figure showing an example of game image shown on the display unit of the game machine. (Embodiment)

FIG. 8 is a game image for "COUNT-UP" game of 8 rounds arrow throw by 2 players. The game has not been started, yet. At the center of the image, there are shown a point indicator 801 ("0" at present) corresponding to hit area of the board TG, points (scores) indicator 802 to 809 of each round, score prediction indicator 810 of the game still in progress, total score indicators 811 and 812 of each player, and finished arrow throw indicators 813, 814 and 815.

Further, an instruction for the 1st player (PLAYER 1) is shown by a message 816. The control unit 100 functions as a point display means concerning the score indication.

Figure 9:
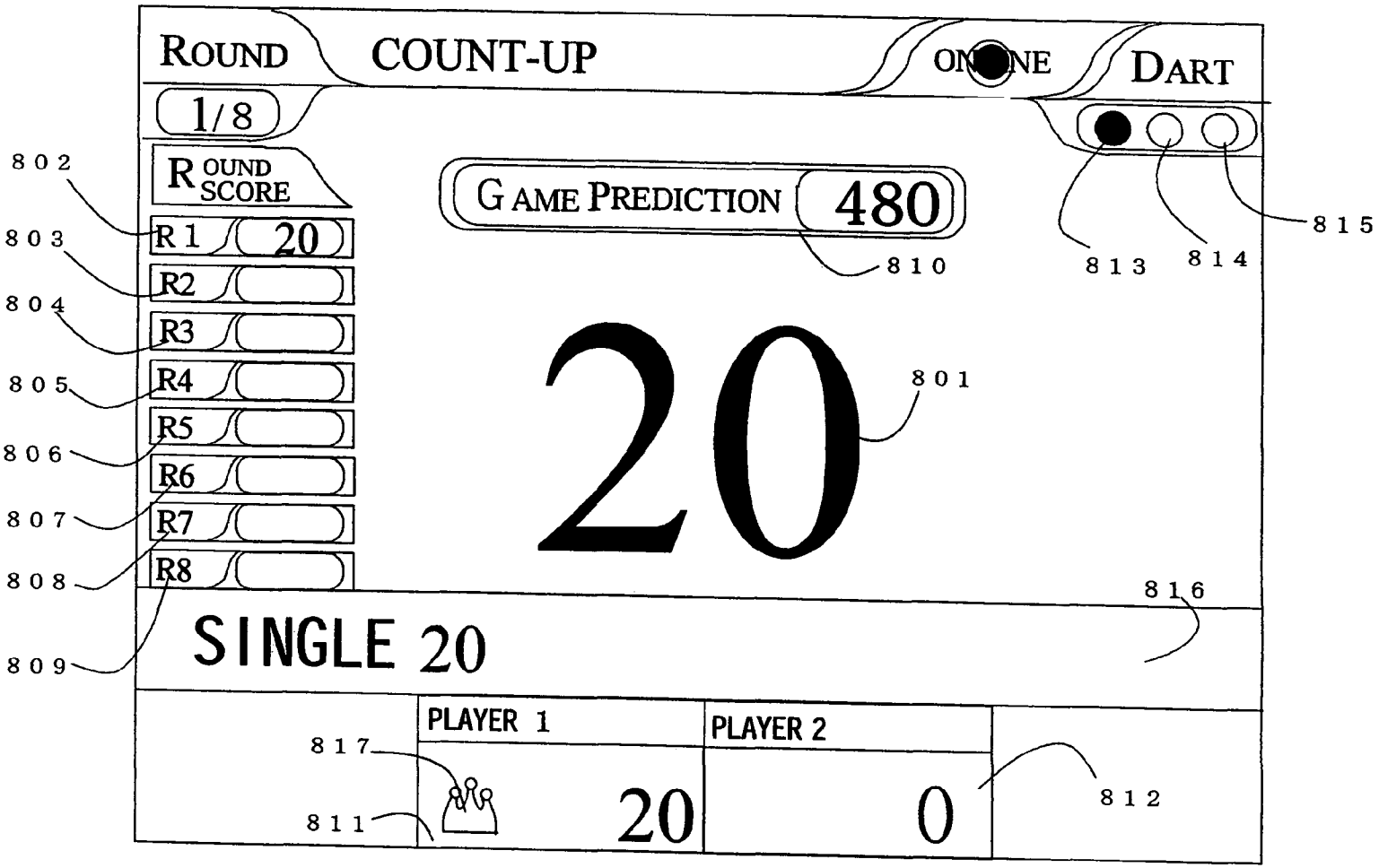
FIG. 9 is a figure showing another example of game image shown on the display unit of the game machine. (Embodiment)

The image of FIG. 9 shows that the player of PLAYER 1 has finished the 1st throw of the 1st round from the situation of FIG. 8 and has obtained a score of "20" point. That is, a score "20" is shown at the indicator 801, a score "20" is shown at the indicator 802, and scores "0" are shown at the indicators from 803 to 809. The indicator 813 is reversed because the arrow throw is finished. In the indicator 810, a predicted score "480" at the end of the 8th round is shown. In the message 816, it is shown that the area hit by the arrow is "single". In the indicator 811, a crown-like symbol 817 showing the current player who has thrown the arrow.

Figure 10:
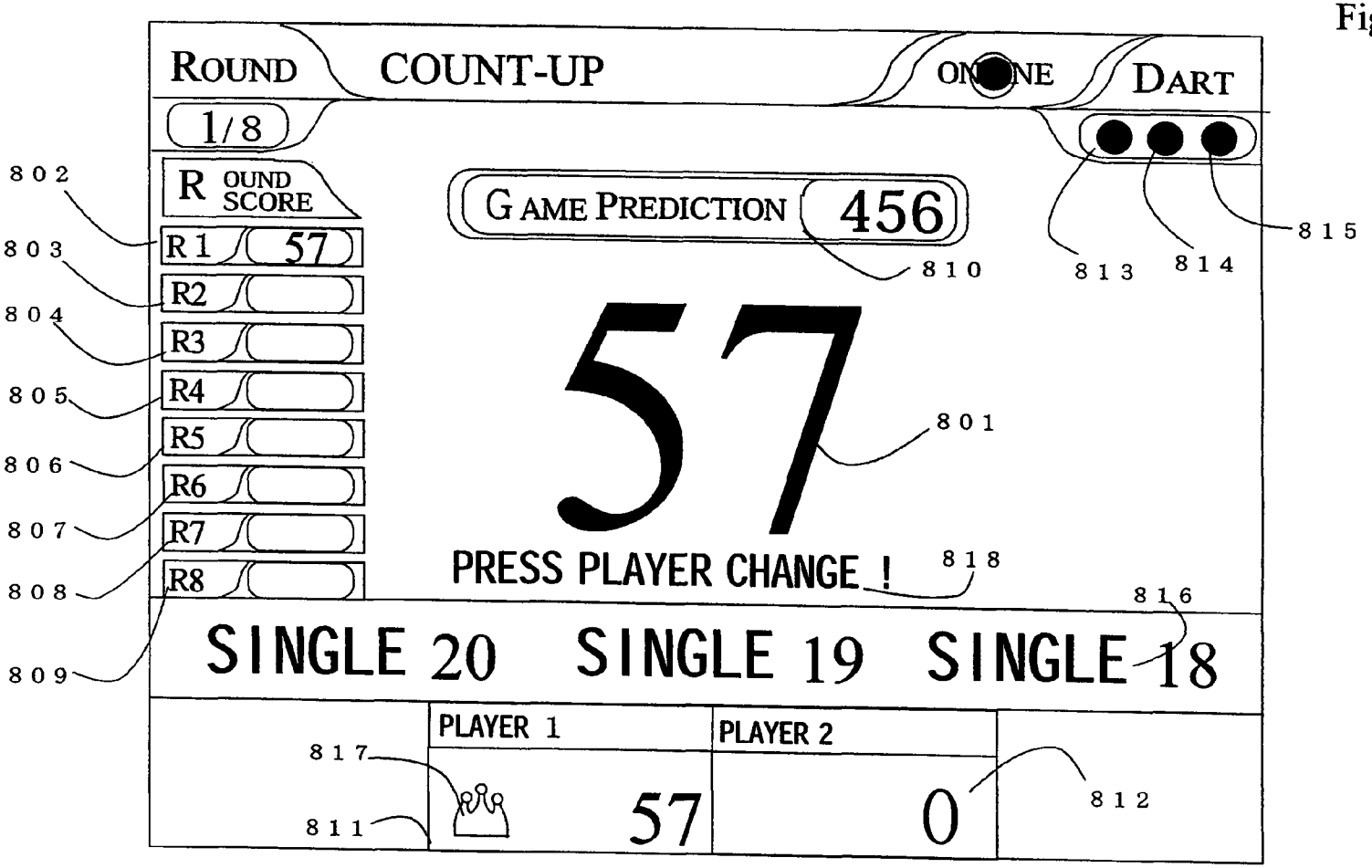
FIG. 10 is a figure showing further another example of game image shown on the display unit of the game machine. (Embodiment)

The image of FIG. 10 shows that the player of PLAYER 1 has finished the 2nd and 3rd throws from the situation of FIG. 9 and has obtained a total score of "57" point. That is, a score "57" is shown at the indicator 801, a score "57" is shown at the indicator 802, and scores "0" are shown at the indicators from 803 to 809. The indicators from 813 to 815 are reversed because the total arrow throws are finished. In the indicator 810, a predicted score "456" at the end of the 8th round is shown. In the message 816, it is shown that the areas hit by the 3 arrows thrown are "single20", "single 19" and "single 18". In the indicator 811, a crown-like symbol 817 is shown. Further, a message is shown under the score 801 that the player change buttons PB1 to PB4 are to be push due to completed arrow throw of the 1st round of the PLAYER 1.

Figure 11:
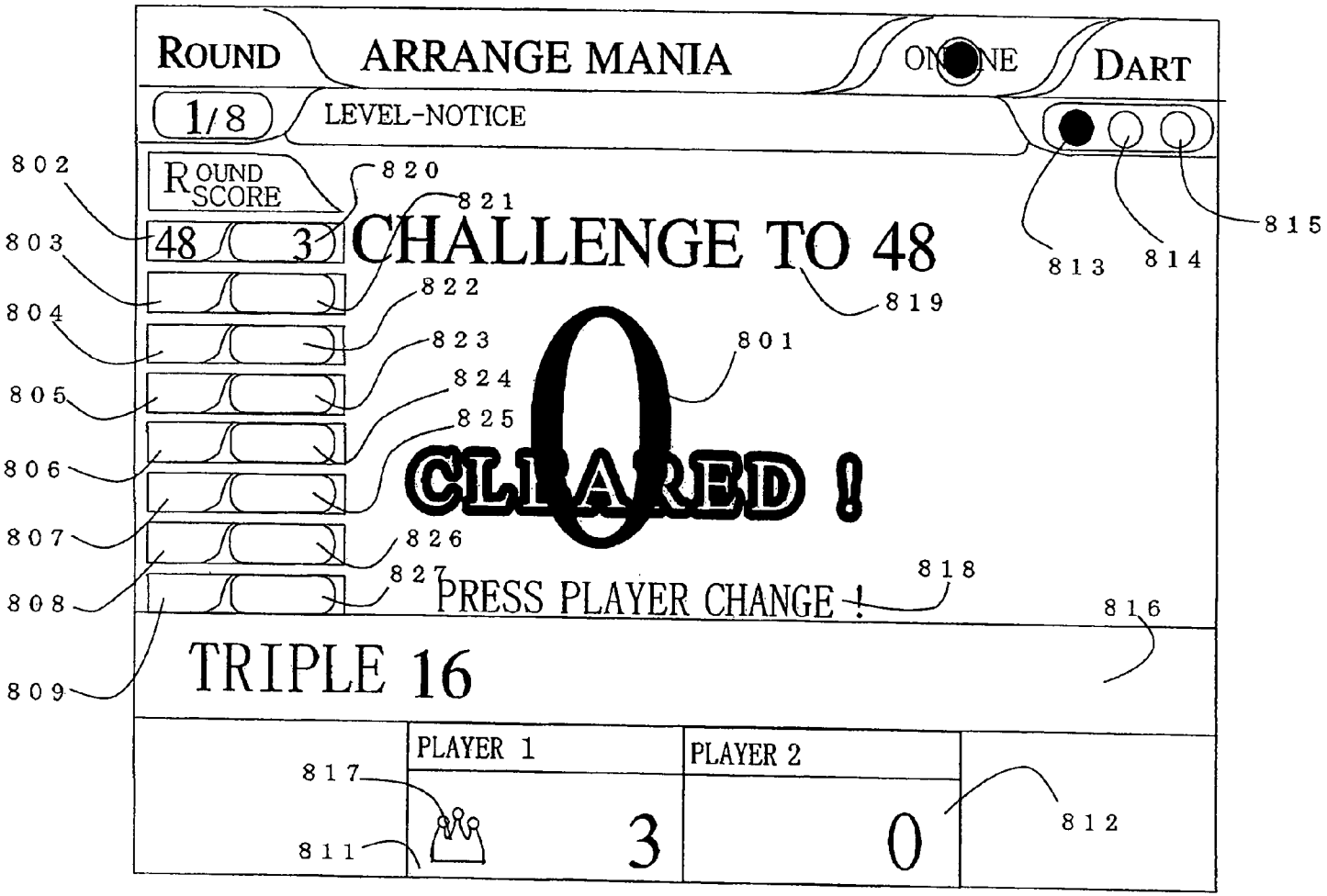
FIG. 11 is a figure showing further another example of game image shown on the display unit of the game machine. (Embodiment)

FIG. 11 is a game image for "ARRANGE MANIA" game of 8 rounds arrow throw by 2 players. The PLAYER 1 has cleared the 1st round by 1 arrow throw. Similarly to "COUNT-UP" in FIGS. 8 to 10, the indicator 801 of the value ("0" at present) which is a subtracted value from "48" by the score, the score indicators 802 to 809 of each round, point indicators from 820 to 827, a indication of "CHALLENGE TO 48" showing the point for clearing each round, the total score indicators 811 and 812 of each player, and finished arrow throw indicators 813, 814*v* and 815. Further, an instruction for the 1st player (PLAYER 1) is made by a message 816. And "TRIPLE 16" is shown as a point obtained by one throw.

The game images above are shown in enough high brightness until the 1st throw is finished in one round. After the 1st throw, the image is changed to a dark and simple image. It is because that the light image prevents players from concentrated throw. The dart image improves the arrow throw circumstance. When a player pushes the player change button PB1 to PB4, it is judged that the round is finished and the game image is made lighter again.

The simplification of the image is not only by the darker image but also by other manners such as a translucent image or lighted off image.

[Game Program]

Next, a game program is described, which is executed on the game machines GM1 to GMn and the game system.

Figure 12:
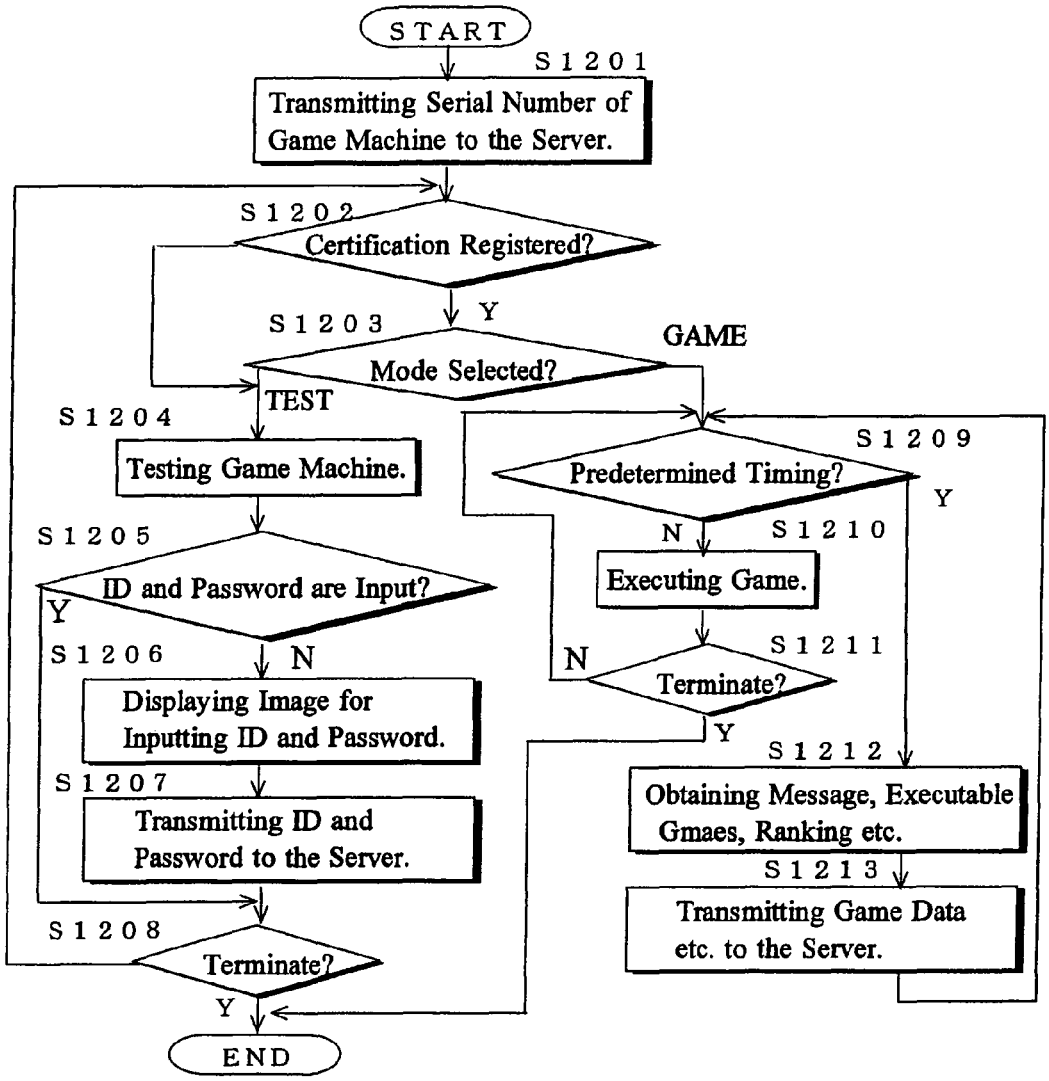
FIG. 12 is a flowchart showing the game machine operation in FIG. 1. (Embodiment)
Figure 13:
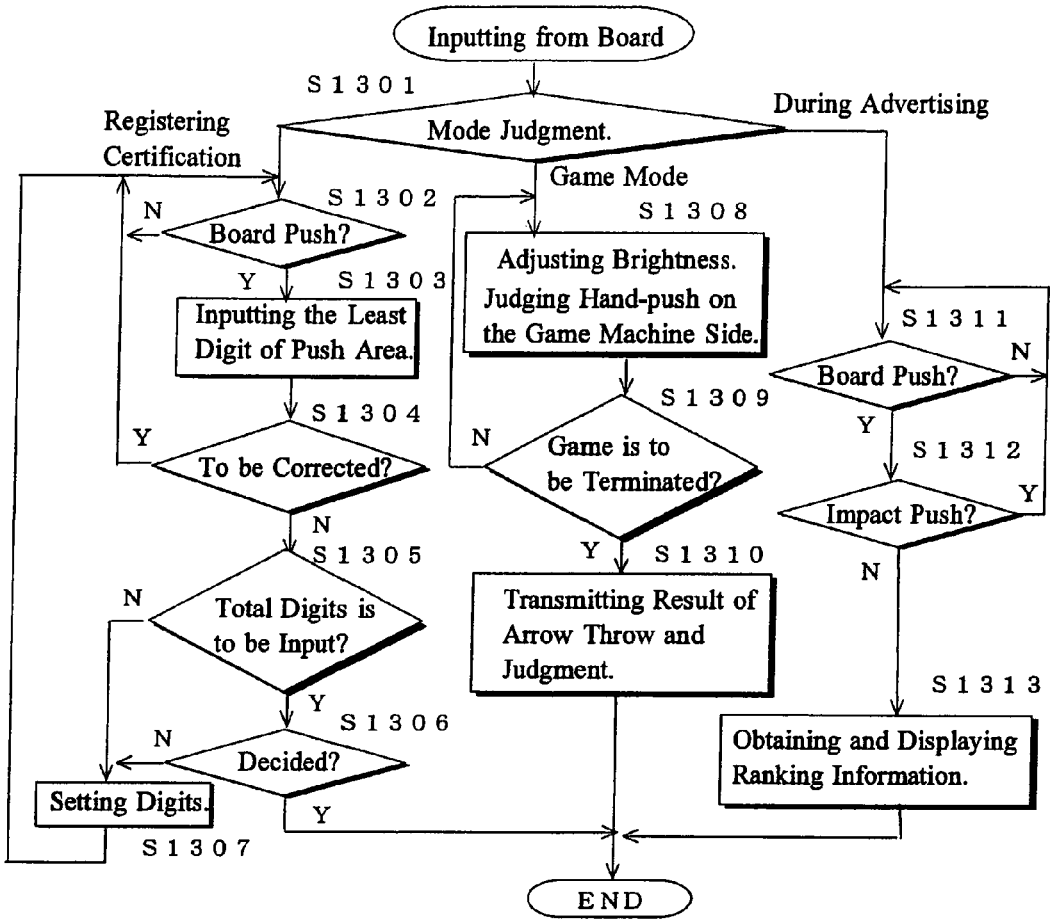
FIG. 13 is a flowchart showing the input operation from the board such as arrow throw on the game machine in FIG. 1. (Embodiment)
Figure 14:
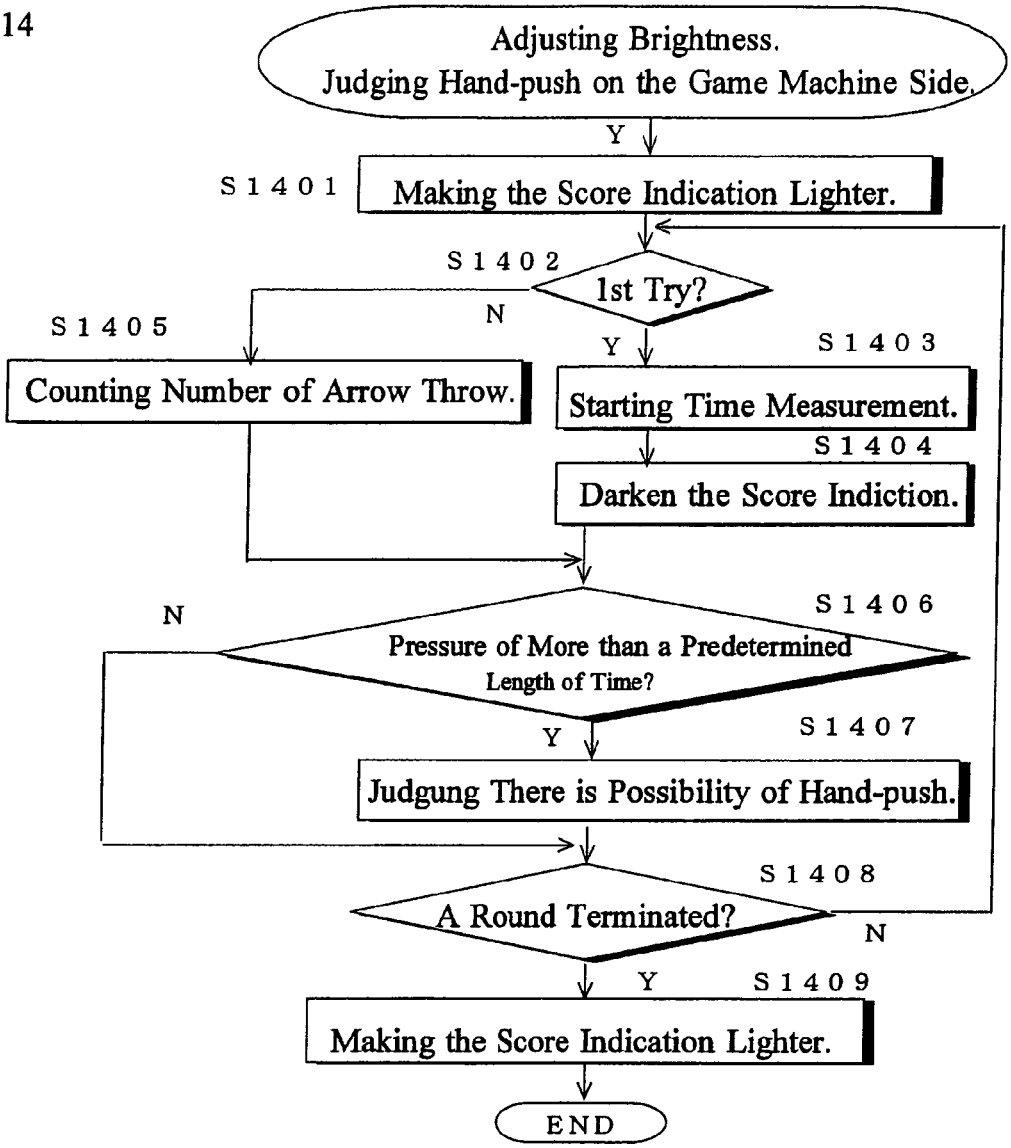
FIG. 14 is a flowchart showing a processing executed in the game machine for detecting unfair operation of "hand-push". (Embodiment)
Figure 15:
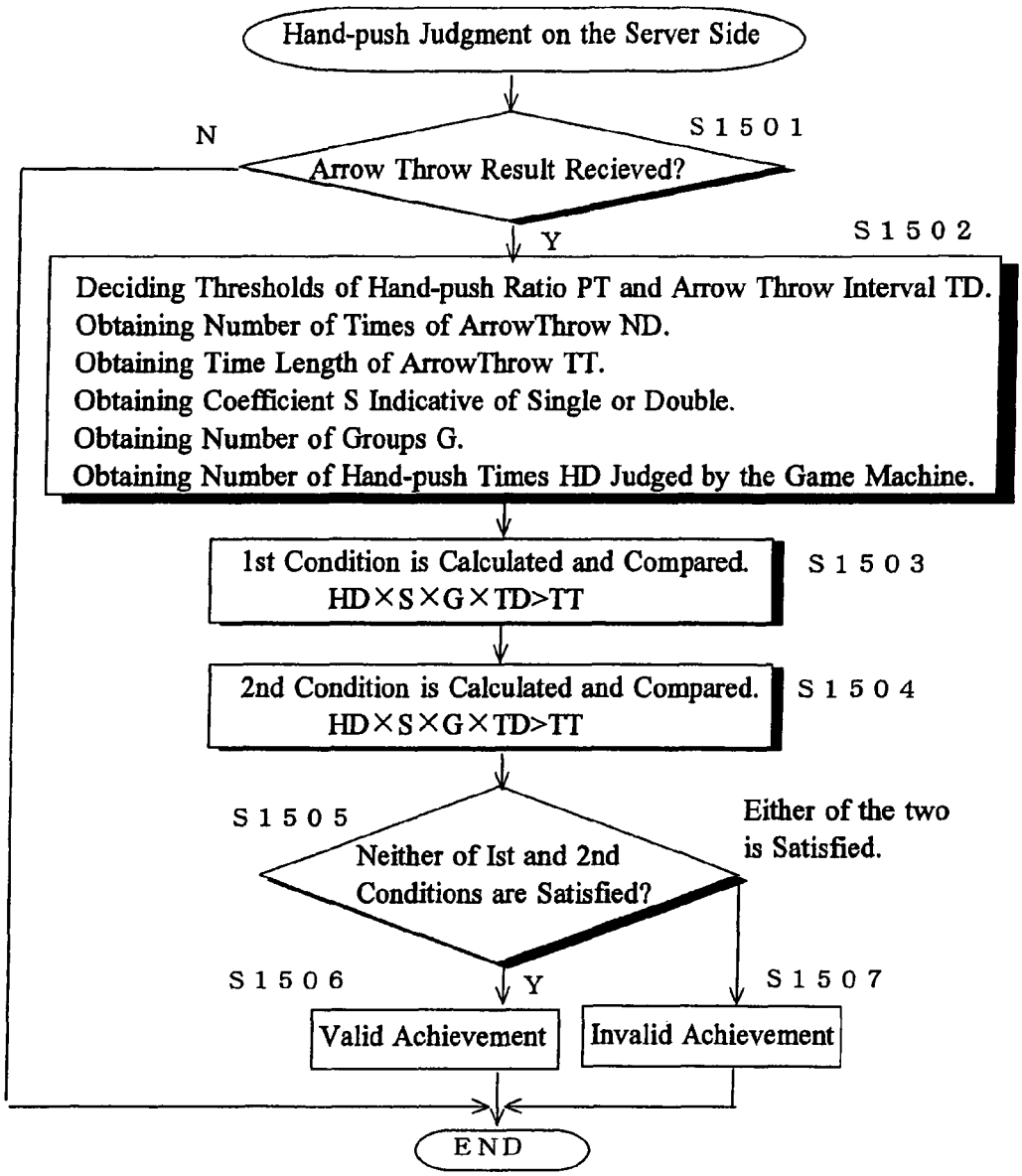
FIG. 15 is a flowchart showing a processing executed in the server for judging "hand-push" according to the processing in the game machine. (Embodiment)
Figure 16:
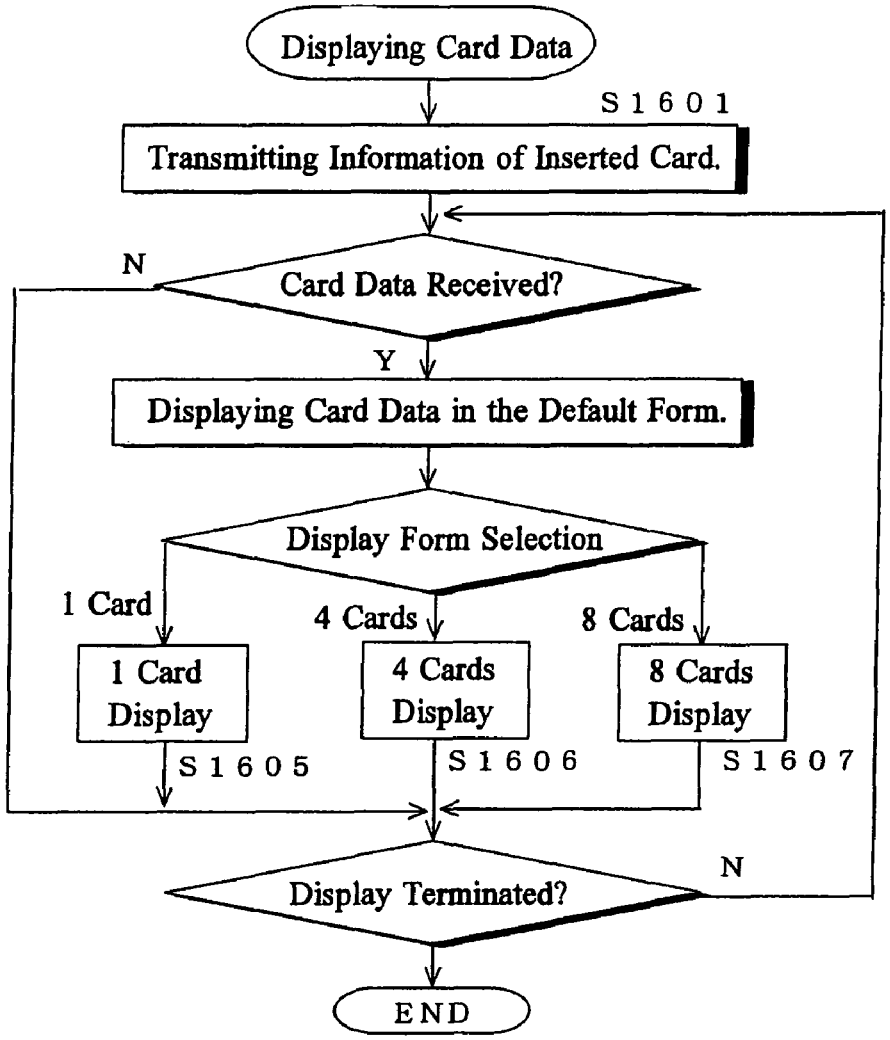
FIG. 16 is a flowchart showing a processing for displaying card data in the game machine in FIG. 1. (Embodiment)
Figure 17:
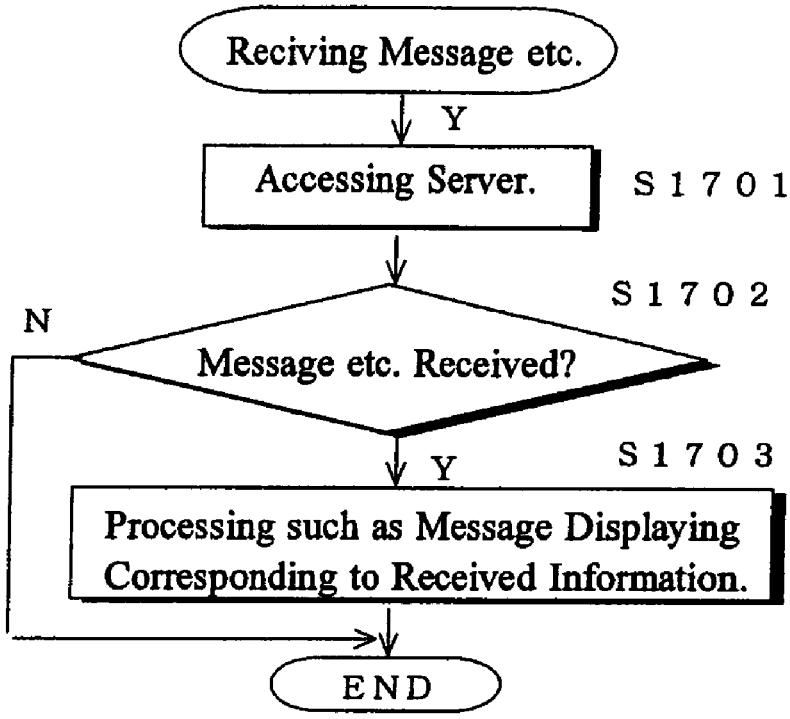
FIG. 17 is a flowchart showing a processing for receiving message etc. in the game machine in FIG. 1. (Embodiment)
Figure 18:
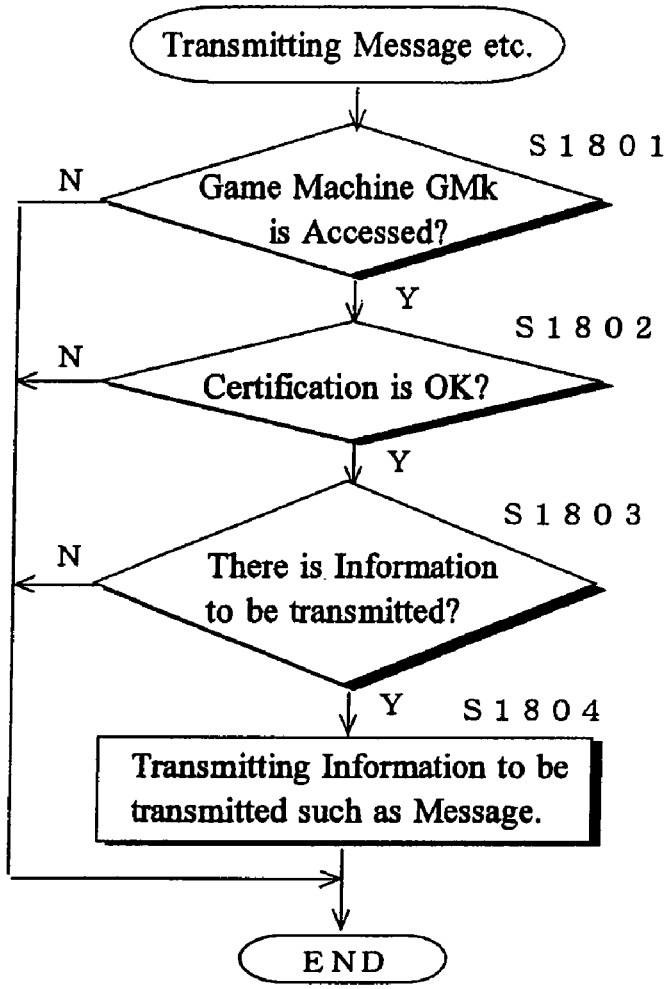
FIG. 18 is a flowchart showing a processing for transmitting message etc. in the game system in FIG. 1. (Embodiment)
Figure 19:
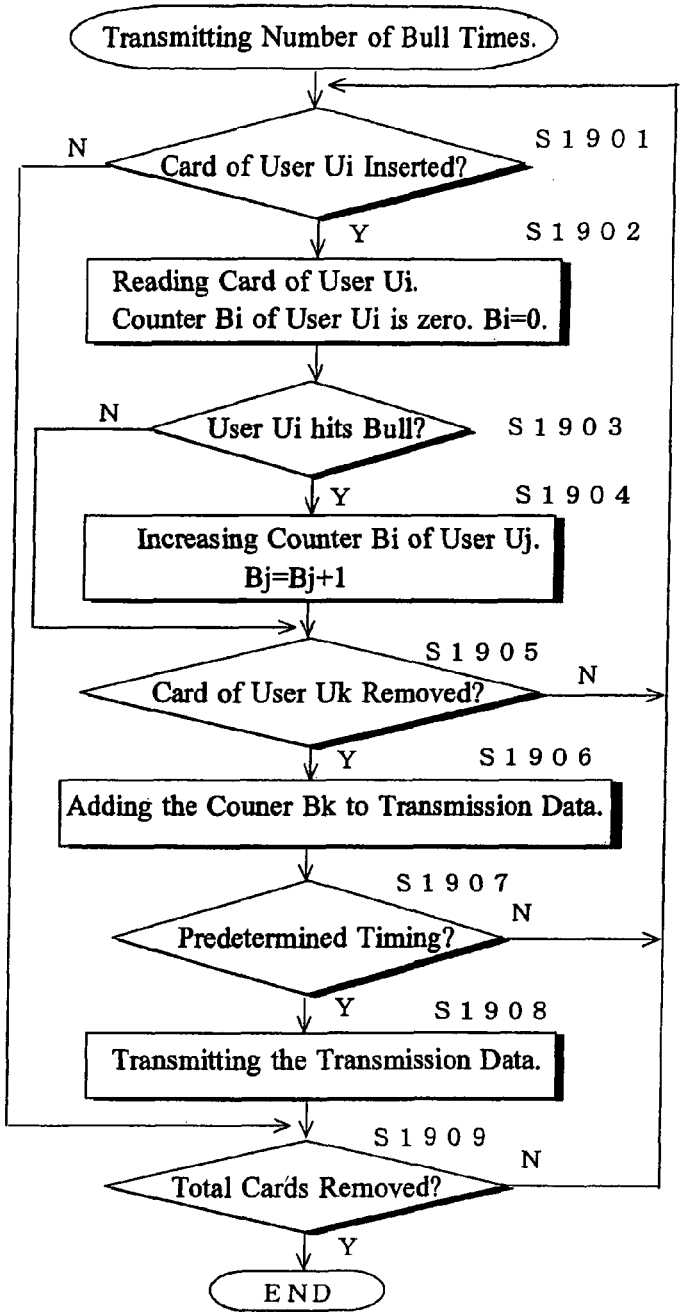
FIG. 19 is a flowchart showing a processing for transmitting number of times of bull in the game machine in FIG. 1. (Embodiment)
Figure 20:
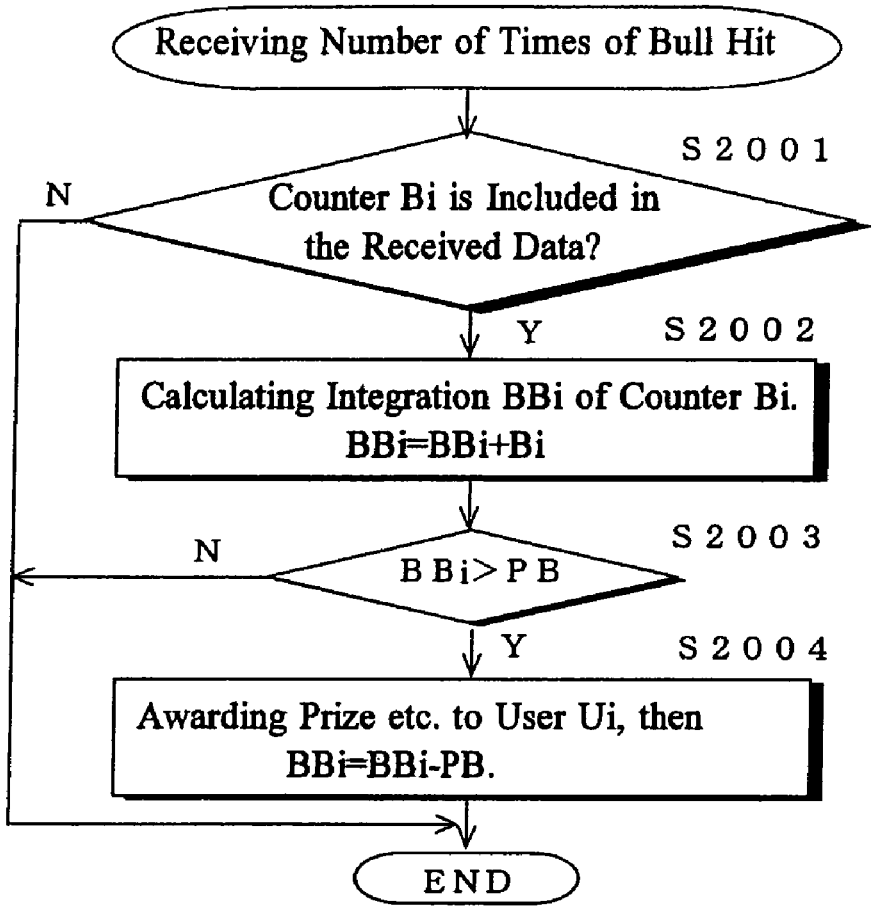
FIG. 20 is a flowchart showing a processing for receiving number of times of bull in the game system in FIG. 1. (Embodiment)

FIG. 12 is a flowchart showing the game machine operation in FIG. 1. FIG. 13 is a flowchart showing the input operation from the board such as arrow throw on the game machine in FIG. 1. FIG. 14 is a flowchart showing a processing executed in the game machine for detecting unfair operation of "hand-push". FIG. 15 is a flowchart showing a processing executed in the server for judging "hand-push" according to the processing in the game machine. FIG. 16 is a flowchart showing a processing for displaying card data in the game machine in FIG. 1. FIG. 17 is a flowchart showing a processing for receiving message etc. in the game machine in FIG. 1. FIG. 18 is a flowchart showing a processing for transmitting message etc. in the game system in FIG. 1. FIG. 19 is a flowchart showing a processing for transmitting number of times of bull in the game machine in FIG. 1. FIG. 20 is a flowchart showing a processing for receiving number of times of bull in the game system in FIG. 1.

In FIG. 12, when the game machine (GM1, for example) is started, the game machine GM1 is certified by a peculiar serial number to the game machine (peculiar to the control unit 100). Then, the processing below can be executed.

Step S1201: When the game machine is started, the game machine GM1 transmits the serial number to the server SV. In the server SV, the serial number, an ID number of the manager (a game machine owner, an operator in a game center etc.), a password of each game machine are registered. The server SV permits the usage of the game machine when the game machine is certified by the registered serial number etc.

Step S1202: It is judged whether registration processing for certification of the relationship is completed or not of the serial number of the game machine with the manager's ID number and the password. When the registration is completed, the processing is advanced to the step S1203, otherwise to the step S1204.

Step S1203: It is judged which mode is to be executed, of the "test mode" for executing the registration processing for certification and game machine test and "game mode" for executing the game. When the "test mode" is to be executed, the processing is advanced to the step S1204, and when the "game mode" is to be executed, the processing is advanced to the step S1209.

Step S1204: The game machine test is executed, and the processing is advanced to the step S1205.

Step S1205: It is selected whether the ID and the password are input in order to execute registration processing. When the ID and the password are input, the processing is advanced to the step S1206, otherwise to the step S1208.

Step S1206: An input image is displayed on the display unit 312. After the input, the processing is advanced to the step S1207.

Step S1207: The ID and the password are transmitted to the server SV. The transmitted ID and password are registered together with the relationship with the serial number of the game machine in the server. Concerning the transmission of the ID and password, the control unit 100 functions as a communication means.

Step S1208: Following to the step S1207, it is judged whether the "test mode" is terminated or not. When the "test mode" is to be terminated, the processing is immediately terminated, otherwise, the processing is returned to the step S1202.

Step S1209: In the step S1209, it is judged whether it is the moment to access to the server. During the "game mode", the game machine accesses to the server at a predetermined timing, for example every 20 minutes. When it is the timing to access to the server, the processing is advanced to the step S1212, otherwise, to the step S1210.

Step S1210: A new game or the current game is executed, and the processing is advanced to the step S1211.

Step S1211: It is judged whether the game execution is to be terminated or not. When the game execution is to be terminated, the processing is immediately terminated, otherwise, the processing is returned to the step S1209.

Step S1212: Various information is obtained from the server SV through the access to the server SV. Information includes game kinds executable on each game machine GM1, message to be displayed on each game machine, ranking of the players etc.

Step S1213: Following to the step S1212, the game information etc. are transmitted from the game machine to the server. Then, the processing is returned to the step S1209.

In FIG. 13, the processing is executed by the following steps, when a pressure is put on the board due to arrow hitting etc. during the game execution or in other cases.

Step S1301: First, the operation mode of the game machine is judged. In the operation modes, there are "registration mode" for certification in the "test mode (steps from S1204 to S1208)", "game mode (steps from S1209 to S1213)" and "advertisement mode". The test mode is called the 1st mode that the game is not executed, and the advertisement mode is called the 2nd mode that the game is not executed. When the "registration mode" for certification, the processing is advanced to the step S1302. When the "game mode", the processing is advanced to the step S1308. When the "advertisement mode", the processing is advanced to the step S1312.

Step S1302: The pressure on the board is watched. The processing is advanced to the step S1303 when the pressure is put on the board.

Step S1303: Inputting the least digit or the number allocated to the area in the board TG where the pressure is put, then the processing is advanced to the step S1304. The game machine does not have any input means such as a key-board. However, a simple input operation is possible by the number allocated to the areas on the board TG. Inputting rule is especially simple and useful when only the least digit is used.

Step S1304: It is judged whether the number input in the step S1303 is to be corrected or not. Whether the number is to be corrected or not is selected by the button PB5 for example.

Step S1305: It is judged whether the input of the total digits of the ID and the password is completed or not. When the input of the total digits is completed, the processing is advanced to the step S1306, otherwise, to the step S1307.

Step S1306: It is judged whether the input of the ID and password is decided or not. The decision operation is performed by the buttons PB1 to PB4 for example. When the input is decided, the processing is immediately terminated, otherwise the processing is advanced to the step S1307.

Step S1307: When the digits to be input are partially input, other digits not input are set. Then, the processing is returned to the step S1302.

Step S1308: The brightness of the points (scores) indicators 802 to 809 of the game image is adjusted and the hand-push is judged on the game machine side. Every when the arrow throw of each round is finished, the processing is advanced to the step S1309. As for the brightness adjustment of the score indicators 802 to 809, the control unit functions as a brightness adjusting means.

The hand-push means that a player obtains points unfairly by pushing board TG by hand without throwing arrows. The points should be eliminated from the achievement of the game. The hand-push can be distinguished by the pressure duration time generally. However, sometimes the reaction of the board TG is checked and the board may be push by other operations, so it is inadequate that the score is always voided.

Therefore, in the present game program, the hand-push judgment is made according to the pressure duration time on the game machine side, then, the score is comprehensively judged to be valid or invalid on the server side. As for the hand-push judgment, the sensor 101, encoder 102, I/F 103 and control unit 100 function as hand-push judging means.

Step S1309: It judged whether the game is to be terminated or not. When the game is to be terminated, the processing is advanced to the step S1310, otherwise, returned to the step S1308.

Step S1310: The result of the arrow throw and the hand-push judgment are transmitted to the server. Then, the processing is immediately terminated.

Step S1311: The pressure on the board is watched. The processing is advanced to the step S1312 when the pressure is put on the board. When advertising mode, the processing is executed that ranking of the players is obtained from the server and displayed when the operation of pushing the board by a hand is performed. During the advertising mode, a training arrow throw is permitted. Therefore, it is prevented the ranking is started to be obtained by an arrow throw. And unnecessary access to the server is prevented. As for ranking obtaining, the control unit functions as a communication means.

Step S1312: The pressure duration time on the board TG is judged similarly to the step S1308. When the so-called hand-push is made, the processing is advanced to the step S1313. When not hand-push, that is, the training arrow throw, the processing is advanced to the step S1311.

Step S1313: Through the accessing to the server, the ranking is obtained and displayed.

In FIG. 14, the brightness adjustment of the step S1308 and the hand-push judgment on the game machine side are executed by the following steps.

Step S1401: First, the points (score) indicators from 802 to 809 is adjusted to be lighter so that the state of the game is clearly shown.

Step S1402: Following to the step S1401, it is judged whether the arrow throw is the 1st throw within one round or not. When it is 1st throw, the processing is advanced to the step S1403, otherwise, to the step S1405.

Step S1403: The time measurement is started of the arrow throw, then, the processing is advanced to the step S1404.

Step S1401: The points (score) indicators from 802 to 809 is adjusted to be darker so that the display is simplified. Then, the processing is advanced to the step S1406.

Step S1405: Number of times of the arrow throw is counted, then, the processing is advanced to the step S1406.

Step S1406: It is judged whether the pressure continues for more than a predetermined time or not, that is, it is judged whether there is possibility of hand-push or not. When the pressure continues for more than a predetermined time, the processing is advanced to the step S1407, otherwise, to the step S1407.

Step S1407: A judgment of the hand-push is recorded and the processing is advanced to the step S1408.

Step S1408: It is judged whether one round is finished or not, that is, the total arrow throws of one round are finished or not. When one round is finished, the processing is immediately terminated, otherwise, the processing is returned to the step S1402.

Step S1409: The point (score) indicators from 802 to 809 are adjusted lighter again. Then, the processing is immediately terminated.

According to the processing above, information necessary for the comprehensive judgment of the hand-push is obtained.

In FIG. 15, the server SV judges the hand-push comprehensively by the following steps, when the information concerning the hand-push obtained in FIG. 14 is transmitted to the server in the step S1310.

Step S1501: First, it is judged whether the result of the arrow throw is received or not. When the result of the arrow throw is received, the processing id advanced to the step S1502, otherwise, the processing is immediately terminated.

Step S1502: Parameters for the hand-push judgment are set and necessary information is obtained. As the parameters, a threshold PT of ratio of number of times of hand-push judgment in the step S1308 relative to the total number of arrow throw, and a threshold of time distance between successive arrow throws.

For example, PT is set to be "3" in a usual game, that is, when a number of times of hand-push is not less than ⅓ of the total number of the arrow throw, the game score is deemed as invalid. In a free game, PT=5 for example, that is, when the ratio is not less than ⅕, the game score is deemed as invalid. The threshold TD of the time distance between successive arrow throws is 20 sec for example. When a mean time distance is not more than 20 sec, the arrow throw is deemed to be abnormal and the game score is voided.

The total number of times of arrow throws (designated as ND), the necessary time for the total arrow throws (designated as TT) and the number of times of the hand-push judgment (designated as HD) are sent from the game machine are data for discriminating the PT and TD.

Parameters are set indicating the game is singles or doubles (designated as S), and a number of groups (designated as G). S is "1" when singles, and "2" when doubles. The number of groups means the total participants of players or groups joining in the game. When the number of participants is one person or one group, G is "1", and when two, G is "2".

Step S1503: Following to the step S1502, the 1st condition is judged.

$$HD \times PT > ND \qquad \text{1st Condition:}$$

Step S1504: Following to the step S1503, the 2nd condition is judged.

$$HD \times S \times G \times TD > TT \qquad \text{2nd Condition:}$$

Step S1505: It is judged whether neither the 1st nor 2nd condition is fulfilled. When neither condition is fulfilled, the processing is advanced to the step S1506, otherwise, to the step S1507.

Step S1506: The score (result) sent from the game machine is registered as a valid score. Then, the processing is immediately terminated.

Step S1507: When either the 1st or second condition is fulfilled, the result is voided deeming that there is unfairness of hand-push.

The processing in FIG. 15 can be executed on the game machine side. The game machine may send a comprehensive hand-push judgment to the server, and the server may register the result of the judgment.

In FIG. 16, the display processing of the card data in FIGS. 5 to 7 are executed in the following steps.

Step S1601: The data of the ID card inserted into the card reader CD is sent to the server SV. The game machine requests the server SV related information to the ID card.

Step S1602: The card data sent from the server SV is watched. When the data is received, the processing is advanced to the step S1603. If the data cannot be received, the processing is jumped to the step S1608.

Step S1603: The card data is displayed in a default format, for example, in the format of 8 cards in FIG. 5.

Step S1604: Following to the step S1603, display format selection is available. When the format of 1 card in FIG. 7 is selected, the processing is advanced to the step S1605. When the format of 4 cards in FIG. 6 is selected, the processing is advanced to the step S1606. When the format of 8 cards in FIG. 5 is selected, the processing is advanced to the step S1607.

Step S1605: The card data is displayed in the 1 card display format of FIG. 7, then, the processing is advanced to the step S1608.

Step S1606: The card data is displayed in the 4 cards display format of FIG. 6, then, the processing is advanced to the step S1608.

Step S1607: The card data is displayed in the 8 cards display format of FIG. 5, then, the processing is advanced to the step S1608.

Step S1608: It is judged whether the display is to be terminated or not. When it is to be terminated, the processing is immediately terminated, otherwise, advanced to the step S1602.

The selection of the step S1604 or S1608 and the termination judgment is performed by the buttons from PB1 to PB5 for example.

As for the card data display in FIGS. 5 to 7 and FIG. 16, the control unit 100 functions as a display means.

In FIG. 17, the message receiving processing in the step S1212 is executed by the following steps.

Step S1701: First, the server SV is accessed.

Step S1702: It is judged whether the message or other data is received or not. When none of the data is received, the processing is immediately terminated. When any data is received, the processing is advanced to the step S1703.

Step S1703: Processing corresponding to the data is executed, such as, displaying the received message on the display unit 312, preparing for the change of the executable games and so forth. Then, the processing is immediately terminated.

In FIG. 18, the processing executed on the server SV for the reception processing is executed by the following step.

Step S1801: First, the game machine accessing to the server is discriminated. The game machine is designated as GMk, here.

Step S1802: The game machine GMk is examined for certification. It is judged whether the access is permitted or not. When the access is permitted, the processing is advanced to the step S1803, otherwise, the processing is immediately terminated.

Step S1803: It is judged whether there is data to be transmitted to the game machine GMk. When there is the data, the processing is advanced to the step S1804, otherwise, the processing is immediately terminated.

In FIG. 19, processing is shown for transmitting the number of hit times of the bull of players to the server SV during the game mode. Since the possibility that the bull is hit is rather low, the player who hits the bull feels plenty of satisfaction. The transmission of the number of hit times of bull is executed by the following steps.

Step S1901: It is judged whether a ID card of any player (designated as Ui) is inserted into the card reader CD or not. When a card is inserted, the processing is advanced to the step S1902, otherwise, to the step S1909.

Step S1902: The ID card of the player Ui is read, and a counter Bi of the number of hit times of bull is reset to be "0".

Step S1903: It is judged whether any player Uj hits the bull or not. When the player hits the bull, the processing is advanced to the step S1904, otherwise, to the step S1905.

Step S1904: The counter Bj is increased by "1".

Step S1905: It is judged whether any player Uk removes the ID card or not. When the card is removed, the processing is advanced to the step S1906, otherwise, is returned to the step S1901.

Step S1906: The counter Bk is added to the transmission data for a preparation for the accessing to the server next time. Then, the processing is advanced to the step S1907.

Step S1907: It is judged whether it is the timing of accessing to the server SV. When it is the timing, the processing is advanced to the step S1908, otherwise, is returned to the step S1901.

Step S1908: The transmission data is transmitted to the server. Then, the processing is advanced to the step S1909.

Step S1909: It is judged whether all the ID cards are removed from the card reader or not. When all the ID cards are removed from the card reader, the processing is immediately terminated, otherwise, is returned to the step S1901.

In FIG. 20, the server executes the following steps when the server receives the transmission data in FIG. 19.

Step S201: It is judged whether the counter Bi of any one of the players is included in the received data or not. When the counter Bi is included, the processing is advanced to the step S2002, otherwise, the processing is immediately terminated.

Step S2002: The received number of times Bi is added to a number BBi of hit times of bull which is integrated for the player Ui. Then, the processing is advanced to the step S2003.

Step S2003: It is judged whether the BBi exceeds a predetermined number PB of times or not. PB is a number of hit times of bull for rewarding the player with a prize etc. for example. When BBi>PB, the processing is advanced to the step S2004, otherwise, the processing is immediately terminated.

Step S2004: It is decided that the prize is given to the player Ui and BBi is decreased to be (BBi−PB).

The invention claimed is:

1. A game machine comprising, arrows, a target, a sensor for detecting an area of said target where pressure is put when said pressure is put, a control unit to which a detecting result of said sensor is input, a display monitor controlled by said control unit, a target impact judgment means for identifying and distinguishing between an arrow impact and a push impact, wherein criteria for distinguishing between the arrow impact and the push impact comprises impact time duration, and a valid arrow throw judgment means for judging whether throws of said arrows, respectively, are valid or not, wherein said target is divided into a plurality of areas each of which an indicator is allocated to, said arrows are thrown by said plurality of players successively, and a game is proceeded according to indicators of said areas hit by said arrows, and wherein said valid arrow throw judgement means judges 1st and 2nd conditions, that is, $$HD \times PT > ND \qquad \text{1st condition:}$$

$$HD \times S \times G \times TD > TT, \qquad \text{2nd condition:}$$

where,

ND: number of times of said pressure on said target,

TT: time length necessary for said pressure of ND times,

HD: number of times, among ND times, that said target impact judgment means judges said target is push by other means than said arrows, PT: a threshold of hand-push ratio (HD/ND), TD: a threshold of said time interval of said arrow throw, S: a coefficient concerning single, single game or doubles game, and S=1 when single, and S=2 when doubles, and G: number of groups, so as to judge whether a given arrow throw among said throws is invalid when either said 1st or 2nd condition is fulfilled.

2. A game machine according to claim 1, further comprising a communication means for transmitting number of times and time interval of said pressure on said target and judgment of said target impact judgment means.

3. A game machine comprising, arrows, a target divided into a plurality of areas each of which an indicator is allocated to, a sensor for detecting an area of said target where pressure is put when said pressure is put, a control unit to which a detecting result of said sensor is input, a display monitor controlled by said control unit, a card reader for reading players' ID cards, a communication means for transmitting an ID of a manager of said game machine by said indicators when pressure is put on said target on a predetermined state that said game is not executed, a target impact judgment means for identifying and distinguishing between an arrow impact and a push impact, and a valid arrow throw judgement means for judging whether throws of said arrows, respectively, are valid or not wherein said target is divided into a plurality of areas each of which an indicator is allocated to, said arrows are thrown by said plurality of players successively, and a game is proceeded according to said indicators of said areas hit by said arrows, and wherein said valid arrow throw judgment means judges 1st and 2nd conditions, that is $$HD \times PT > ND, \quad \text{1st condition:}$$

$$HD \times S \times G \times TD > TT, \quad \text{2nd condition:}$$

where,

ND: number of times of said pressure on said target,

TT: time length necessary for said pressure of ND times,

HD: number of times, among ND times that said target impact judgement means judges said target is push by other means than said arrows, PT: a threshold of hand-push ratio (HD/ND), TD: a threshold of said time interval of said arrow throw, S: a coefficient concerning single, single game or doubles game, and S=1 when single, and S=2 when doubles and G: number of groups, so as to judge whether a given arrow throw anion said throws is invalid when either said 1st or 2nd condition is fulfilled.

4. A game machine comprising, arrows, a target divided into a plurality of areas each of which an indicator is allocated to, a sensor for detecting an area of said target where pressure is put when said pressure is put, a control unit to which a detecting result of said sensor is input, a display monitor controlled by said control unit, a card reader for reading players' ID cards, a communication means for executing communication in order to obtain a ranking of said players when pressure is put on said target on a predetermined state that game is not executed, a target impact judgement means of distinguishing between an arrow impact and a push impact, and a valid arrow throw judgment means for judging whether throws of said arrows, respectively are valid or not, wherein said target is divided into a plurality of areas each of which an indicator is allocated to, said arrows are thrown by said plurality of players successively, and a game is proceeded according to said indicators of said areas hit by said arrows, and wherein said valid arrow throw judgment means judges 1st and 2nd conditions, that is $$HD \times PT > ND, \quad \text{1st condition:}$$

$$HD \times S \times G \times TD > TT, \quad \text{2nd condition:}$$

where

ND: number of times of said pressure on said target,

TT: time length necessary for said pressure of ND times,

HD: number of times, among ND times that said target impact judgement means judges said target is push by other means than said arrows PT: a threshold of hand-push ratio (HD/ND), TD: a threshold of said time interval of said arrow throw S: a coefficient concerning single, single game or double game, and S=1 when single, and S=2 when doubles, and G: number of groups, so as to judge whether a given arrow throw among said throws is invalid when either said 1st or 2nd condition is fulfilled.

5. A game machine according to any one of claims from 1 to 4 on which said game is proceeded by predetermined times of arrow throw of each said player, said game machine further comprising, a point display means for displaying points of said players on said display monitor according to indicators corresponding to said areas hit by said arrows, and a brightness adjusting means for making said point display lighter at 1st throw among predetermined throw times, for adjusting said point display darker after said 1st throw, and making said point display lighter again after said predetermined throw times.

6. A game system comprising a game machine and a server, said dame machine comprising, arrows a target, a sensor for detecting an area of said tar et where pressure is put when said pressure is put, a control unit to which a detecting result of said sensor is input, a display monitor controlled by said control unit, a card reader for reading players' ID cards, a target impact judgement means for identifying and distinguishing between an arrow impact and a push impact, wherein criteria for distinguishing between the arrow impact and the push impact comprises impact time duration, and a communication means for transmitting number of times and time interval of said pressure on said target and judgement of said target impact judgment means, wherein said target is divided into a plurality of areas each of which an indicator is allocated arrows are thrown by said plurality of players successively, and a game is proceeded according to indicators of said areas hit by said arrows, and said server comprising, a player information control means for controlling information of said ID cards and achievement corresponding to said ID cards, and a valid arrow throw judgment means for judging whether said arrow throw is valid or not according to said number of times and said time interval of said pressure on said target and said judgment of said target impact judgment means which are transmitted from said communication means; and wherein said valid arrow throw judgment means judges 1st and 2nd conditions, that is, $$HD \times PT > ND, \quad \text{1st condition:}$$

$$HD \times S \times G \times TD > TT, \quad \text{2nd condition:}$$

where,

ND: number of times of said pressure on said target,

TT: time length necessary for said pressure of ND times,

HD: number of times, among ND times, that said target impact judgment means judges said target is push by other means than said arrows, PT: a threshold of hand-push ratio (HD/ND), TD: a threshold of said time interval of said arrow throw, S: a coefficient concerning single, single game or doubles game, and S=1 when single, and S=2 when doubles, and G: number of groups, so as to judges said arrow throw is invalid when either said 1st or 2nd condition is fulfilled.

7. A non-transitory memory storage medium, readable by a computer, which stores a game program including program codes executable by a computer, for a game machine which comprises a sensor for detecting an area of a target where pressure is put when said pressure is put, a control unit to which a detecting result of said sensor is input, and a display monitor controlled by said control unit, wherein said target is divided into a plurality of areas each of which an indicator is allocated to, said arrows are thrown by said plurality of players successively, and a game is proceeded according to indicators of said areas hit by said arrows, the game program comprising, target impact judgment program code for identifying and distinguishing between an arrow impact and a push impact, wherein criteria for distinguishing between the arrow impact and the push impact comprises impact time duration, said target impact judgment program code implementing a method comprising:

judging a $1^{st}$ condition, that is, $$HD \times PT > ND \quad 1^{st} \text{ condition:}$$

where,

ND: number of times of said pressure on said target,

TT: time length necessary for said pressure of ND times,

HD: number of times, among ND times, that said target impact judgment program code determines said target is push by other means than said arrows, PT: a threshold of hand-push ratio (HD/ND), TD: a threshold of said time interval of said arrow throw, S: a coefficient concern single game or doubles game, and S−1 when single, and S=2 when doubles, and G: a number of groups, judging a $2^{nd}$ condition, that is, $$HD \times S \times G \times TD > TT, \text{and} \quad 2^{nd} \text{ condition:}$$

judging that said arrow throw is invalid when either said $1^{st}$ or $2^{nd}$ condition is fulfilled, otherwise, valid.

* * * * *